US006595613B2

(12) United States Patent
Fujimori

(10) Patent No.: US 6,595,613 B2
(45) Date of Patent: Jul. 22, 2003

(54) PRINTING SYSTEM THAT ENABLES ADJUSTMENT OF POSITIONAL MISALIGNMENT OF DOT CREATION, EQUIVALENT METHOD OF ADJUSTMENT, AND RECORDING MEDIUM

(75) Inventor: Yukimitsu Fujimori, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 36 days.

(21) Appl. No.: 09/796,353

(22) Filed: Mar. 2, 2001

(65) Prior Publication Data

US 2001/0030671 A1 Oct. 18, 2001

Related U.S. Application Data

(63) Continuation of application No. PCT/JP00/04391, filed on Jun. 30, 2000.

(30) Foreign Application Priority Data

Jul. 2, 1999 (JP) ..... 11-189132

(51) Int. Cl.[7] ..... B41J 29/393
(52) U.S. Cl. ..... 347/14; 347/19
(58) Field of Search ..... 347/10, 14, 15, 347/19, 37, 39, 43; 400/74

(56) References Cited

U.S. PATENT DOCUMENTS 4,222,060 A * 9/1980 Sato et al. ..... 347/9
4,672,432 A * 6/1987 Sakurada et al. ..... 347/43
5,416,613 A * 5/1995 Rolleston et al. ..... 358/518
6,024,438 A * 2/2000 Koike et al. ..... 347/43
6,082,911 A * 7/2000 Murakami ..... 400/74
6,084,606 A * 7/2000 Moriyama ..... 347/19
6,109,722 A * 8/2000 Underwood et al. ..... 347/19
6,154,228 A * 11/2000 Okuda et al. ..... 347/15
6,196,736 B1 * 3/2001 Otsuki et al. ..... 400/124.01
6,257,689 B1 * 7/2001 Yonekubo ..... 347/11
6,260,938 B1 * 7/2001 Ohtsuka et al. ..... 347/15

FOREIGN PATENT DOCUMENTS

| | | | |
|---|---|---|---|
| EP | 0 816 102 | 1/1998 | |
| EP | 982 139 A1 * | 3/2000 | ..... B41J/2/21 |
| JP | 6-86133 | 11/1994 | |
| JP | 7-84081 | 9/1995 | |
| JP | 7-98409 | 10/1995 | |
| JP | 9-58017 | 3/1997 | |
| JP | 9-156102 | 6/1997 | |
| JP | 9-174828 | 7/1997 | |
| JP | 10-35025 | 2/1998 | |
| JP | 10-81012 | 3/1998 | |
| JP | 10-244691 | 9/1998 | |
| JP | 2000-62156 | 2/2000 | |

OTHER PUBLICATIONS

Frank Cost, Pocket Guide to Digital Printing, 1997, Thomson Learning, pp. 35–54.*

* cited by examiner

*Primary Examiner*—Craig Hallacher
*Assistant Examiner*—Blaise Mouttet
(74) *Attorney, Agent, or Firm*—Oblon, Spivak, McClelland, Maier & Neustadt, P.C.

(57) ABSTRACT

Bidirectional recording is carried out with a printer that enables variable size dots of different ink quantities to be created with different driving waveforms W1 and W2. Variables are set to a time delay n0 before output of the driving waveform W1 and a time interval n6 between the driving waveform W1 and the driving waveform W2. The output timings n0 and n6 of the driving waveforms W1 and W2 in the course of a backward pass of main scan are individually regulated on the basis of dots created in a forward pass of the main scan as a reference. This arrangement desirably reduces a positional misalignment of dots created in the forward pass with dots created in the backward pass with regard to each of the variable size dots having different ink quantities, thus ensuring high-quality printing.

39 Claims, 22 Drawing Sheets

Fig.19

| FOR-WARD PASS \ BACK-WARD PASS | | K | | | C | | | LC | | | M | | | ··· |
|---|---|---|---|---|---|---|---|---|---|---|---|---|---|---|
| | | L DOT | M DOT | S DOT | L DOT | M DOT | S DOT | L DOT | M DOT | S DOT | L DOT | M DOT | S DOT | |
| K | L DOT | ① | | | | | | | | | | | | |
| | M DOT | | ④ | | | | | | | | | | | |
| | S DOT | | | ⑤ | | | | | | | | | | |
| C | L DOT | ② | | | ③ | | | | | | | | | |
| | M DOT | | | | | ④ | | | | | | | | |
| | S DOT | | | | | | ⑤ | | | | | | | |
| LC | L DOT | ② | | | | | | ③ | | | | | | |
| | M DOT | | | | | | | | ④ | | | | | |
| | S DOT | | | | | | | | | ⑤ | | | | |
| M | L DOT | ② | | | | | | | | | ③ | | | |
| | M DOT | | | | | | | | | | | ④ | | |
| | S DOT | | | | | | | | | | | | ⑤ | |
| ⋮ | | | | | | | | | | | | | | |

Fig.21
| | K | C | M | Y |
|---|---|---|---|---|
| FORWARD PASS | REF-ERENCE | 2 | 3 | 4 |
| BACKWARD PASS | 4 | 5 | 4 | 2 |
Fig.22
(a)
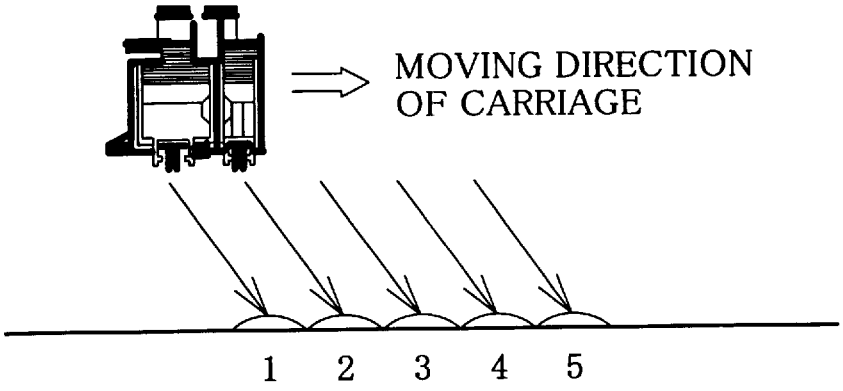
(b)
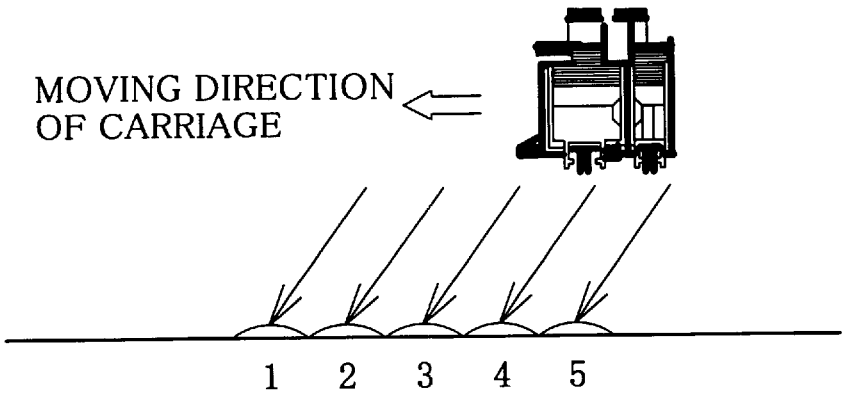

PRINTING SYSTEM THAT ENABLES ADJUSTMENT OF POSITIONAL MISALIGNMENT OF DOT CREATION, EQUIVALENT METHOD OF ADJUSTMENT, AND RECORDING MEDIUM

This application is of continuation application PCT/JP00/04391 filed on Jun. 30, 2000.

CROSS-REFERENCE TO A RELATED APPLICATION

This application is related to Japanese Patent Application No. 11-189132, filed on Jul. 2, 1999, the entire contents of which are incorporated.

BACKGROUND OF THE INVENTION

1. Field of the Invention

The present invention relates to a printing system that enables adjustment of positional misalignment of dot creation, an equivalent method of adjustment, and a recording medium.

2. Discussion of the Background

Ink jet printers that cause ink to be ejected from a print head and thereby implement printing have been widely used as an output device of the computer. The ink jet printer moves the print head back and forth relative to a printing medium during a main scan and ejects multiple color inks to create dots. Variable dot printers that are capable of expressing multiple densities with regard to each pixel, instead of just two stages, dot-on and dot-off, have recently been proposed. The multiple densities are attained, for example, by creating dots of different ink quantities.

In some of these ink jet printers, dots are created during both forward and backward movements in the main scanning direction for the purpose of enhancing the recording speed (hereinafter this recording process is referred to as bidirectional recording). In this case, it is required to make the positions of dots created in the forward pass coincident with the positions of dots created in the backward pass in the main scanning direction. A relative positional misalignment between dots created in the forward pass and dots created in the backward pass is attributable to a rough touch to a resulting printed image and deteriorates the picture quality of the resulting printed image. One proposed method to reduce such a positional misalignment utilizes a predetermined test pattern for the adjustment. The background art technique adjusts the creation timings of, for example, black dots in the forward pass and in the backward pass to reduce the positional misalignment of dots in the course of bidirectional recording.

This background art adjustment technique can not, however, sufficiently reduce the positional misalignment of dots in the variable dot printer that creates dots of different ink quantities. The flight characteristics of an ink droplet ejected from the print head depend upon the ink quantity. In some cases, even when the dot creation timing is adjusted for one of the variable dots, the adjustment of the dot creation timing may be insufficient for the other dots. The background art adjustment technique leaves some dots having an insufficiently corrected positional misalignment in the course of bidirectional recording. This causes deterioration of the picture quality in the case of bidirectional recording.

In the case of bidirectional recording, even a slight positional misalignment of dot creation often significantly affects the picture quality. For example, it is assumed that a print head moves left and right during a main scan and creates dots in the forward pass at positions deviated leftward from the expected positions. Because of the characteristic of the print head, dots are created in the backward pass at positions deviated rightward from the expected positions. The relative positional misalignment between the dots created in the forward pass and the dots created in the backward pass in the course of bidirectional recording is approximately twice the positional misalignment of dots created in only one of the forward pass and the backward pass. Namely, the presence of dots having insufficiently adjusted creating positions significantly deteriorates the picture quality in the case of bidirectional recording.

The printer is generally required to perform high-quality and high-speed printing. Bidirectional recording with a printing speed almost double that of unidirectional recording is desirable for the purpose of the high-speed printing. Due to the positional misalignment of dots discussed above, bidirectional recording produces a reduced picture quality and is thus used in a print mode that gives preference to printing speed over picture quality. With the recent advance of the printer for the higher resolution and a higher picture quality, an image tends to be printed by a greater number of passes of the main scan. Since unidirectional recording has a low printing speed, the enhanced printing speed of the bidirectional recording is highly demanded. The recent trend simultaneously requires an extremely high picture quality, even in the case of bidirectional recording. In the variable dot printer that enables a multi-value expression in each pixel for the improved picture quality, the deterioration of the picture quality due to the positional misalignment of dots in the course of bidirectional recording is of great significance.

The variable dot printer varies the quantity of ink ejected from an identical nozzle and enables dots of different ink quantities to be created in respective pixels. No technique has been proposed to adjust the positional misalignment of variable dots created by the identical nozzle. Further, different ink quantities generally result in different flight velocities of the ink droplets. There is accordingly a positional misalignment of dots having different ink quantities even when they are created by the identical nozzle.

The ink ejection timing is set in advance to prevent the positional misalignment by taking into account the differences in flight velocity. However, it is extremely difficult to completely cancel such a positional misalignment, since there is a variation in flight velocity of the ink droplet due to the variation in manufacturing error of the print head. The positional misalignment of dots is also ascribed to a variation in thickness of printing paper. In the case of thick printing paper, there is a smaller distance between the print head and the printing paper. This shortens the flight time of the ink droplet. In the case of thin printing paper, on the contrary, the ink droplet has a longer flight time. The ejection timings to form the ink droplets of different flight velocities at an identical position are set, based on the relation to the flight time. When the thickness of the printing paper is changed from the initial setting, there is a positional misalignment of ink droplets. Such a positional misalignment significantly damages the picture quality even in the case of creating dots only in one direction of the main scan.

SUMMARY OF THE INVENTION

Accordingly, one object of the present invention is to solve the above-noted and other problems.

Another object of the present invention is to provide a technique that reduces a positional misalignment of dots in the course of bidirectional recording in a printing system that enables variable expression in each pixel.

At least part of the above and the other related objects is attained by a printing system that creates dots on a printing medium with a print head in the course of main scan and thereby prints an image. The print head is capable of creating n variable dots (where n is an integer of not less than 2), which at least partly include dots of an identical ink but different ink quantities, in response to driving signals. The printing system also includes a memory that stores output timings of n driving signals corresponding to the n variable dots, a driving signal output unit that outputs at least part of the n driving signals to the print head in the course of the main scan, according to dots to be created in respective pixels, and a timing adjustment unit that individually adjusts the output timing stored in the memory with regard to each of the n variable dots.

The printing system of the present invention enables the output timings of the driving signals to be adjusted with regard to each of the n variable dots creatable by the print head. This arrangement effectively reduces the positional misalignment of the respective dots and thereby improves the picture quality of the printed image. The n variable dots include dots of an identical ink but different ink quantities.

A printer using dots of different ink quantities has recently been developed. There has been substantially no discussion on the necessity of adjusting the position of dot creation according to the quantity of ink. In general, dot forming elements provided on the print head are commonly used to create dots of an identical ink but different ink quantities. There has also been substantially no discussion on the necessity of adjusting the output timings of the driving signals for each ink quantity. The inventors of the present invention have found that the commonly used dot forming elements may cause a positional misalignment of dots having different ink quantities and that such a positional misalignment of dots significantly deteriorates the picture quality. The inventors have also noticed that adjustment of the output timings of the driving signals for each ink quantity with regard to the dot forming elements commonly used to create a plurality of variable dots significantly improves the picture quality.

Further, the term 'adjustment' in the specification represents a process of varying the output timings in response to a predetermined external operation or in response to an input of an instruction while the printing system is in a working state. It is not necessary that all the n variable dots have different ink quantities. For example, in a printing system which creates dots with multiple color inks or with inks of different densities, the n variable dots may include dots of an identical ink quantity, but different hues or different densities. The requirement is that all the n variable dots do not have an identical ink quantity.

In accordance with one preferable application of the printing system according to the present invention, the memory stores the output timings of the n driving signals with regard to a forward pass of the main scan separately from those with regard to a backward pass of the main scan. The driving signal output unit outputs at least part of the n driving signals to the print head in each of the forward pass and the backward pass of the main scan. Further, the timing adjustment unit individually adjusts the output timing stored in the memory with regard to each of the n variable dots, so as to allow a relative change of the output timing in the backward pass to the output timing in the forward pass.

The printing system of such an arrangement enables the output timings of the driving signals in the backward pass of the main scan and the output timings in the forward pass to be regulated relative to each other with regard to each of the n variable dots creatable by the print head. Either one of the output timings in the forward pass and the output timings in the backward pass may be regulated, or the output timings in both the forward pass the backward pass may be regulated individually. Regulating the dot creation timings in the forward pass and the backward pass relative to each other effectively reduces the positional misalignment arising in the course of bidirectional recording with regard to each of the variable dots, thereby significantly improving the picture quality of the resulting printed image.

Further, a diversity of configurations may be applied for the adjustment of the output timing of the driving signal according to the structure of the print head that is capable of the n variable dots.

In accordance with one preferable embodiment, the printing system of the present invention further includes: a reference signal output unit that outputs a reference signal, which is related to the output of the driving signal, at a fixed period corresponding to each pixel, based on a rate of the main scan. In this embodiment, the print head drives specific elements that correspond to the n variable dots, in order to create the n variable dots, and the memory stores therein a delay time from the reference signal as each of the output timings.

The printing system of such arrangement has the specific elements that correspond to the n variable dots and are provided on the print head. Namely the driving signal output to each pixel is one-to-one mapped to the type of dot created in the pixel. The arrangement of storing the delay time individually for each of the driving signals enables adjustment of the output timing. It is not necessary to provide n different elements, but a plurality of specific elements may be driven simultaneously to attain the n different states.

In accordance with another embodiment of the printing system, the driving signal output unit includes: an original driving signal output unit that successively outputs a plurality of original driving signals to each pixel; and a selection unit that selects at least part of the original driving signals, so as to generate the n driving signals corresponding to the n variable dots. In this embodiment, the memory stores therein an interval of each original driving signal as each of the output timings.

The printing system of such arrangement selects the on-off state of the plurality of original driving signals output to each pixel, so as to create the n variable dots. The simplest configuration successively outputs n different original driving signals, which respectively correspond to the n variable dots, to each pixel and selects one of the n different original driving signals to create the corresponding dot. In this application, the position of the dot created in each pixel is adjusted by regulating the interval of the selected original driving signal. In this structure, the desired dot may be created with a plurality of the original driving signals allocated to each pixel. It is not necessary to output the n different original driving signals to each pixel, but the requirement is that the n different driving signals are actualized by the combinations of the on-off state of the plural original driving signals.

In accordance with still another preferable embodiment, the printing system of the present invention further includes a test pattern printing unit that prints a predetermined test pattern, which is set to enable detection of a relative positional misalignment of dots created under different printing conditions, with regard to each of the n variable dots.

This arrangement enables the user of the printing system to relatively easily adjust the positional misalignment of dots. Here the different printing conditions include, for example, different directions of the main scan to create dots, different print heads used to create dots, and different driving waveforms used to create dots.

In the application that performs the adjustment based on the test pattern, it is preferable that the timing adjustment unit adjusts the output timing, based on relation to the printed result of the predetermined test pattern.

One concrete procedure prints the test patterns with indexes representing the respective output timings and selects the index to specify the desired output timing that gives the optimum printed result. This further facilitates the adjustment.

The variable dot printer generally uses a large number of variable dots, which are the potential target of adjustment of the positional misalignment. It is of course possible to successively adjust the output timing for all these variable dots. But this method takes an extremely long time for the adjustment and requires significantly burdensome work.

In one preferable embodiment of the application that adjusts the output timing based on the test pattern, the printing further includes: an inter-dot comparison pattern printing unit that prints predetermined patterns, in each of which dots created under different printing conditions are mixed, with regard to at least two variable dots of interest creatable by the print head, in a specific arrangement that enables mutual comparison; and a selecting instruction input unit that inputs a selecting instruction to select a specific dot among the at least two variable dots of interest, which are subjected to the printing by the inter-dot comparison pattern printing unit. In this embodiment, the test pattern printing unit prints the predetermined test pattern with regard to the selected specific dot.

This arrangement enables the user to compare the predetermined patterns printed by the inter-dot comparison pattern printing unit with each other and select the dot having a significant positional misalignment arising in the course of bidirectional recording. The adjustment based on the test pattern is performed only for the selected specific dot. This arrangement significantly alleviates the burden of the adjustment.

A diversity of conditions can be set to the different printing conditions in the inter-dot comparison pattern printing unit according to the dots of interest specified as the target of adjustment. For example, in the case where the n variable dots of an identical color but different ink quantities are specified as the target of adjustment, the predetermined pattern includes the dots created in the different directions of the main scan. When the three variable size dots, that is, the large-sized dot, the medium-sized dot, and the small-sized dot, are specified as the target of adjustment, three patterns are printed; the pattern in which dots created in the forward pass are mixed with dots created in the backward pass with regard to the large-sized dot, the pattern in which dots created in the forward pass are mixed with dots created in the backward pass with regard to the medium-sized dot, and the pattern in which dots created in the forward pass are mixed with dots created in the backward pass with regard to the small-sized dot. The user selects the pattern having the most significant rough touch among these three.

In the case where the dots of different colors are specified as the target of adjustment, the predetermined pattern includes the dots created with different inks. When the dots of cyan, magenta, and yellow are specified as the target of adjustment, two patterns are printed; the pattern in which dots of cyan and magenta are mixed and the pattern in which dots of cyan and yellow are mixed. The user selects the pattern having the more significant rough touch between these two and carries out the adjustment of the output timing with regard to the selected color. This arrangement enables the positional misalignment of dots to be adjusted using cyan as the reference color. In this example, magenta or yellow may alternatively be set as the reference color.

In the printing system of the present invention, the output timing of the driving signal corresponding to each of the variable dots is adjusted on the basis of the ideal timing that is specified by the relation to the pixel as the absolute criterion.

The timing adjustment unit may adjust the output timing of another driving signal corresponding to another dot, relative to the output timing of one driving signal corresponding to one reference dot selected among the n variable dots. Namely this unit adjusts the output timing of another driving signal relative to the dot creation timing of the reference dot.

In the application that relatively adjusts the output timing, the reference dot may be any of the n variable dots.

In one desirable embodiment, the reference dot has a substantially intermediate ink ejection speed among the n variable dots.

In another desirable embodiment, the reference dot has a substantially intermediate output timing of the corresponding reference signal among the n variable dots.

The former application selects the dot having the substantially intermediate ink ejection speed, that is, the ink ejection speed close to the '(maximum ink ejection speed+minimum ink ejection speed)/2' as the reference dot when the n variable dots have different ink ejection speeds. The latter application pays attention to the previous output timings and selects the dot having the substantially intermediate output timing, that is, the output timing close to the '(earliest output timing+latest output timing)/2' as the reference dot.

Selecting the reference dot in this manner advantageously enables the output timings of the driving signals with regard to the other dots to be readily adjusted. For example, in the case where the dot having the extremely early output timing is set as the reference dot, there is a possibility that the driving signal is to be output prior to supply of print data corresponding to each pixel, with regard to the dot that requires the earlier output timing than that of the reference dot. In the case where the dot having the extremely late output timing is set as the reference dot, on the contrary, there is a possibility that the driving signal is to continuously output even after the time point when print data corresponding to a next pixel is supplied, with regard to the dot that requires the later output timing than that of the reference dot. In either case, appropriate printing can not be attained. The selection of the dot having the substantially intermediate output timing as the reference dot ensures the appropriate adjustment of the output timing without causing such problems. The above description is also applicable for the ink ejection speed.

In the above applications, the substantially intermediate ink ejection speed and the substantially intermediate output timing are just the standards for selecting the dot that enables adequate adjustment of the output timing as the reference dot. It is not necessary that the ink ejection speed or the output timing of the reference dot is strictly identical with its intermediate value. It is also not necessary to select the dot having the substantially intermediate value as the reference dot.

The technique of the present invention is also attained by a method of adjusting the positional misalignment of dots as discussed below, other than the printing system.

The present invention is thus directed to a method of individually adjusting an output timing of each driving signal corresponding to each of n variable dots in order to correct a relative positional misalignment of dots, in a printing system that creates dots on a printing medium with a print head in the course of main scan and thereby prints an image. Here the print head is capable of creating n variable dots (where n is an integer of not less than 2), which at least partly include dots of an identical ink but different ink quantities, in response to driving signals. The method includes the steps of: (a) printing a predetermined test pattern, which is set to enable detection of a relative positional misalignment of dots created under different printing conditions, with regard to each of the n variable dots; (b) inputting a preset output timing of a selected driving signal, which is specified, based on a relation to the printed test pattern; and (c) changing an existing value of the output timing to the input output timing.

Like the printing system that adjusts the positional misalignment of dots based on the printed test pattern, this method enables the positional misalignment of dots to be adjusted relatively easily. This arrangement allows the adjustment of the positional misalignment with regard to each of the n variable dots and thereby significantly improves the picture quality of the resulting printed image.

In accordance with one preferable application of the present invention, the method further includes the following steps, prior to the step (a): (a1) printing predetermined patterns, in each of which dots created under different printing conditions are mixed, with regard to at least two variable dots of interest creatable by the print head, in a specific arrangement that enables mutual comparison; and (a2) inputting a selecting instruction to select a specific dot among the at least two variable dots of interest, which are subjected to the printing in the step (a1). In this application, the step (a) prints the predetermined test pattern with regard to the specific dot selected in the step (a2).

As discussed previously on the printing system, when there are a large number of dots, which are the potential target of adjustment, this arrangement effectively alleviates the burden of the adjustment. As in the case of the printing system, a variety of conditions according to the dots of interest specified as the target of adjustment may be set to the different printing conditions.

When the print head is capable of creating dots with multiple color inks, it is preferable that the method includes the steps of: (A) carrying out the steps (a) through (c) with regard to dots created under different printing conditions with one identical ink selected among the multiple color inks; and (B) carrying out the steps (a) through (c) with regard to dots created with different inks selected among the multiple color inks.

This arrangement enables adjustment of the positional misalignment, which occurs in the course of bidirectional recording, between variable size dots having different ink quantities as well as between different color inks. The steps (A) and (B) may be carried out in a variety of combinations. One applicable procedure adjusts the positional misalignment between variable size dots having different ink quantities with regard to each color ink in the step (A) and subsequently adjusts the positional misalignment between different color inks in the step (B). Another applicable procedure adjusts the positional misalignment between variable size dots with regard to one selected reference color in the step (A), subsequently adjusts the positional misalignment between different color inks in the step (B), and again adjusts the positional misalignment between variable size dots with regard to the other color inks but the reference color in the step (A). In the method of this arrangement, either of the steps (A) and (B) may accompany the steps (a1) and (a2) discussed above.

The technique of the present invention is further attained by a recording medium discussed below.

The present invention is accordingly directed to a recording medium in which a program is recorded in a computer readable manner to individually adjust an output timing of each driving signal corresponding to each of n variable dots and thereby correct a relative positional misalignment of dots in a printing system that creates dots on a printing medium with a print head in the course of main scan and thereby prints an image. Here the print head is capable of creating the n variable dots (where n is an integer of not less than 2), which at least partly include dots of an identical ink but different ink quantities, in response to driving signals. The program causes a computer to attain: a test pattern printing function that prints a predetermined test pattern, which is set to enable detection of a relative positional misalignment of dots created under different printing conditions, with regard to each of the n variable dots; a function of inputting a preset output timing of a selected driving signal, which is specified, based on a relation to the printed test pattern; and a function of changing an existing value of the output timing to the input output timing.

In accordance with one preferable application, the program further causes the computer to attain: an inter-dot comparison pattern printing function that prints predetermined patterns, in each of which dots created under different printing conditions are mixed, with regard to at least two variable dots of interest creatable by the print head, in a specific arrangement that enables mutual comparison; and a function of inputting a selecting instruction to select a specific dot among the at least two variable dots of interest, which are subjected to the printing by the inter-dot comparison pattern printing function. Here the test pattern printing function prints the predetermined test pattern with regard to the selected specific dot.

Execution of the above program attains the printing system and the method discussed above. Typical examples of the recording medium include flexible disks, CD-ROMs, magneto-optic discs, IC cards, ROM cartridges, punched cards, prints with barcodes or other codes printed thereon, internal storage devices (memories like a RAM and a ROM) and external storage devices of the computer, and a variety of other computer readable media. The present invention may also be directed to a program itself for attaining the functions discussed above and a variety of signals equivalent thereto.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 19 shows variable dots that are to be subjected to the adjustment of the dot creation timing in the printer;

FIG. 21 shows a timing table as an example;

FIG. 22 shows variations in position of dot creation according to the moving direction of the carriage;

DESCRIPTION OF THE PREFERRED EMBODIMENTS

Figure 1:
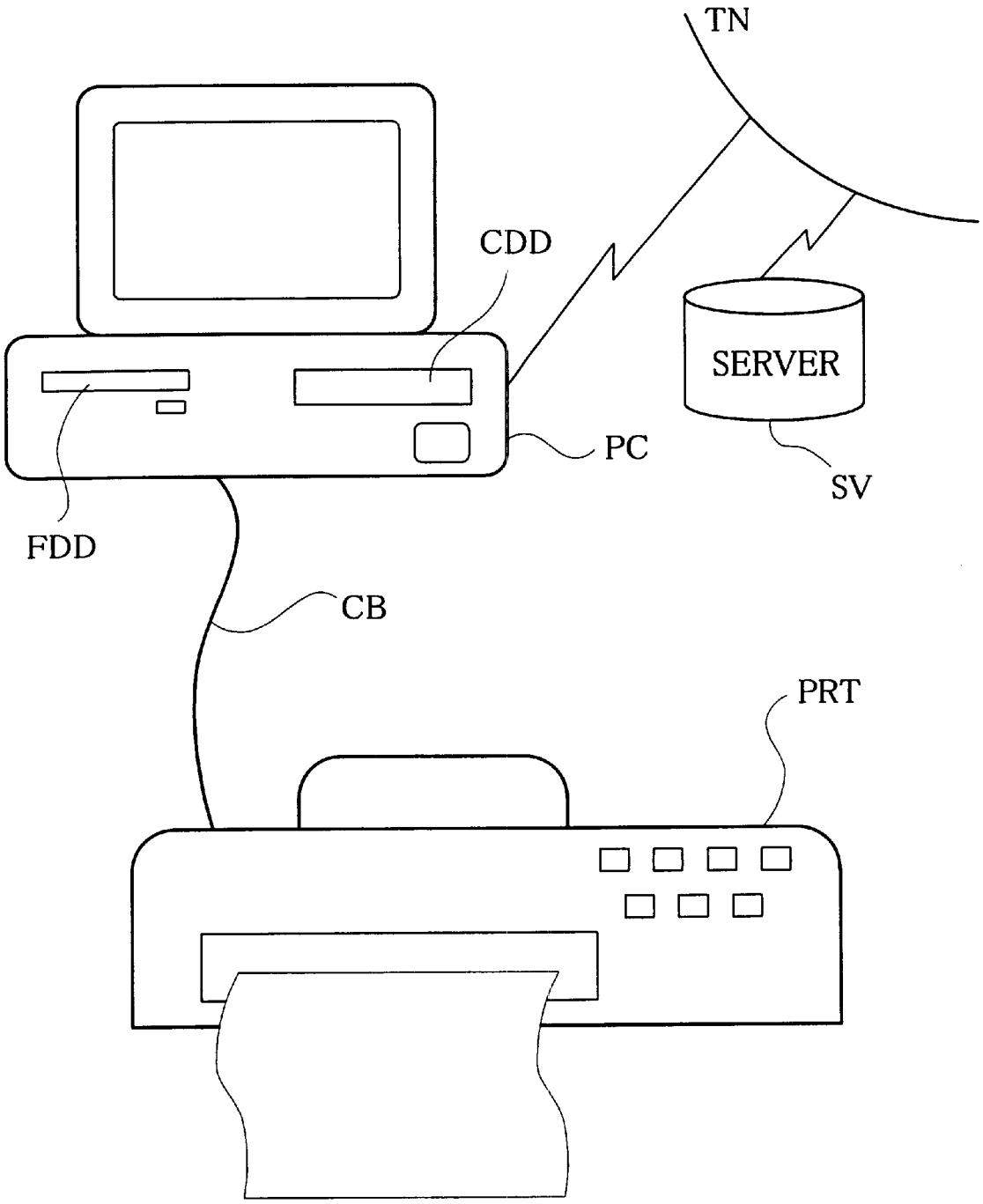
FIG. 1 shows the structure of a printing system using a printer PRT in one example of the present invention.

Referring now to the drawings, wherein like reference numerals designate identical or corresponding parts throughout the several views.

FIG. 1 shows the structure of a printing system using a printer PRT according to the present invention. As shown, the printer PRT is connected to a computer PC via a communication link CB and receives print data from the computer PC to implement printing. The print data specifies the dots to be created in respective pixels. The computer PC executes software called a printer driver to activate the functions of the printer PRT. Further, the computer PC is connected to an external network TN and communicates with a specific server SV to download a required program and data for driving the printer PRT. The computer PC may alternatively load the required program and data from a recording medium, such as a flexible disk or a CD-ROM set in a flexible disk drive FDD or a CD-ROM drive CDD. The entire program required for printing may be loaded comprehensively, or part of the functions of the program may be loaded as modules.

Figure 2:
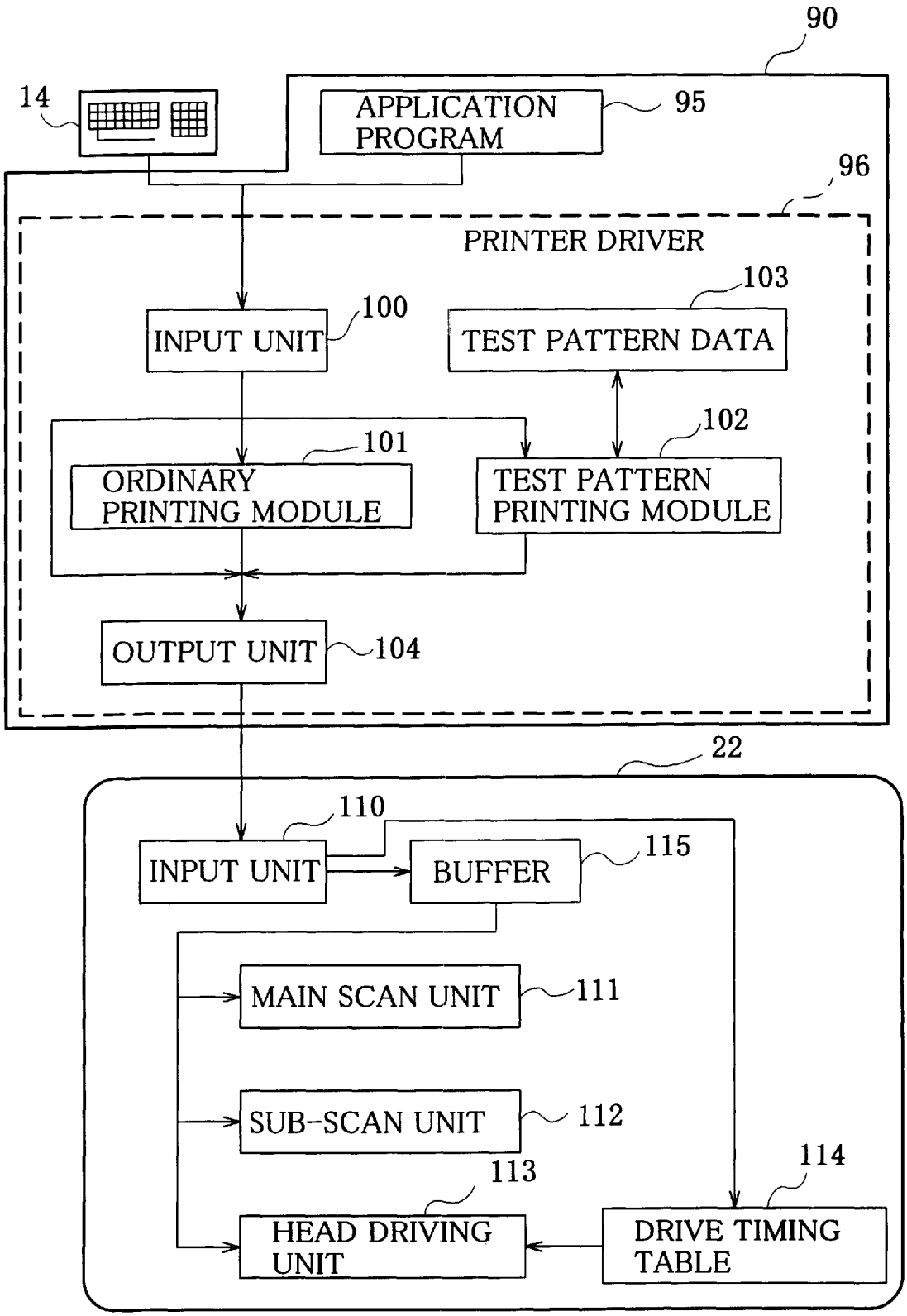
FIG. 2 is a block diagram showing the software configuration of the printing system shown in FIG. 1.

Turning now to FIG. 2, which is a block diagram showing the software configuration of the printing system of the embodiment. In a computer 90, an application program 95 works under the control of a predetermined operating system, and a printer driver 96 is incorporated in the operating system. The application program 95 reads images from a scanner 12 and performs required image processing, for example, retouching of the images.

The printer driver 96 receives commands input from a keyboard 14 and printing instructions transmitted from the application program 95 via an input unit 100. The printer driver 96 performs a required series of processing based on the input. In response to a printing instruction transmitted from the application program 95, the printer driver 96 receives image data from the application program 95 and causes an ordinary printing module 101 to convert the input image data to print data processible by the printer PRT. The ordinary printing module 101 performs a color correction process that converts the color components of the input image data into the color components corresponding to inks used in the printer PRT. The module 101 also performs a halftoning process that expresses the tone values of the input image data as a distribution of dots, and a rastrization process that reorders the resulting data, which have undergone the two preceding processes, in a specified sequence to be actually transferred to the printer PRT. The processed print data are transferred from an output unit 104 to the printer PRT.

One of the processes performed by the printer driver 96 in response to a command input from the keyboard 14 is adjusting the dot creation timing in the printer PRT. When an instruction is given to adjust the dot creation timing, a test pattern printing module 102 included in the printer driver 96 prints a test pattern according to test pattern data 103 stored in advance. Print data for printing the test pattern are output from the output unit 104 to the printer PRT.

In the printer PRT, an input unit 110 receives the print data transferred from the printer driver 96 and temporarily stores the print data into a buffer 115. A main scan unit 111 and a sub-scan unit 112 respectively perform a main scan of a print head and feed printing paper according to the print data stored in the buffer 115, while a head driving unit 113 drives the print head to print an image. The printer PRT is also capable of creating dots in both forward and backward passes of the main scan. The drive times of the print head is stored in a drive timing table 114.

The dot creation timing is adjusted in the following manner. First, a user specifies an optimum print timing through an operation of the keyboard 14, based on the result of the printed test pattern. The printer driver 96 inputs the specified print timing via the input unit 100 and outputs the specified print timing from the output unit 104 to the printer PRT. The input unit 110 of the printer PRT receives the data regarding the specified print timing and rewrites the contents of the drive timing table 114, so as to change the dot creation timing. The software configuration discussed above enables the printing system to print an image while adjusting the dot creation timing.

Figure 3:
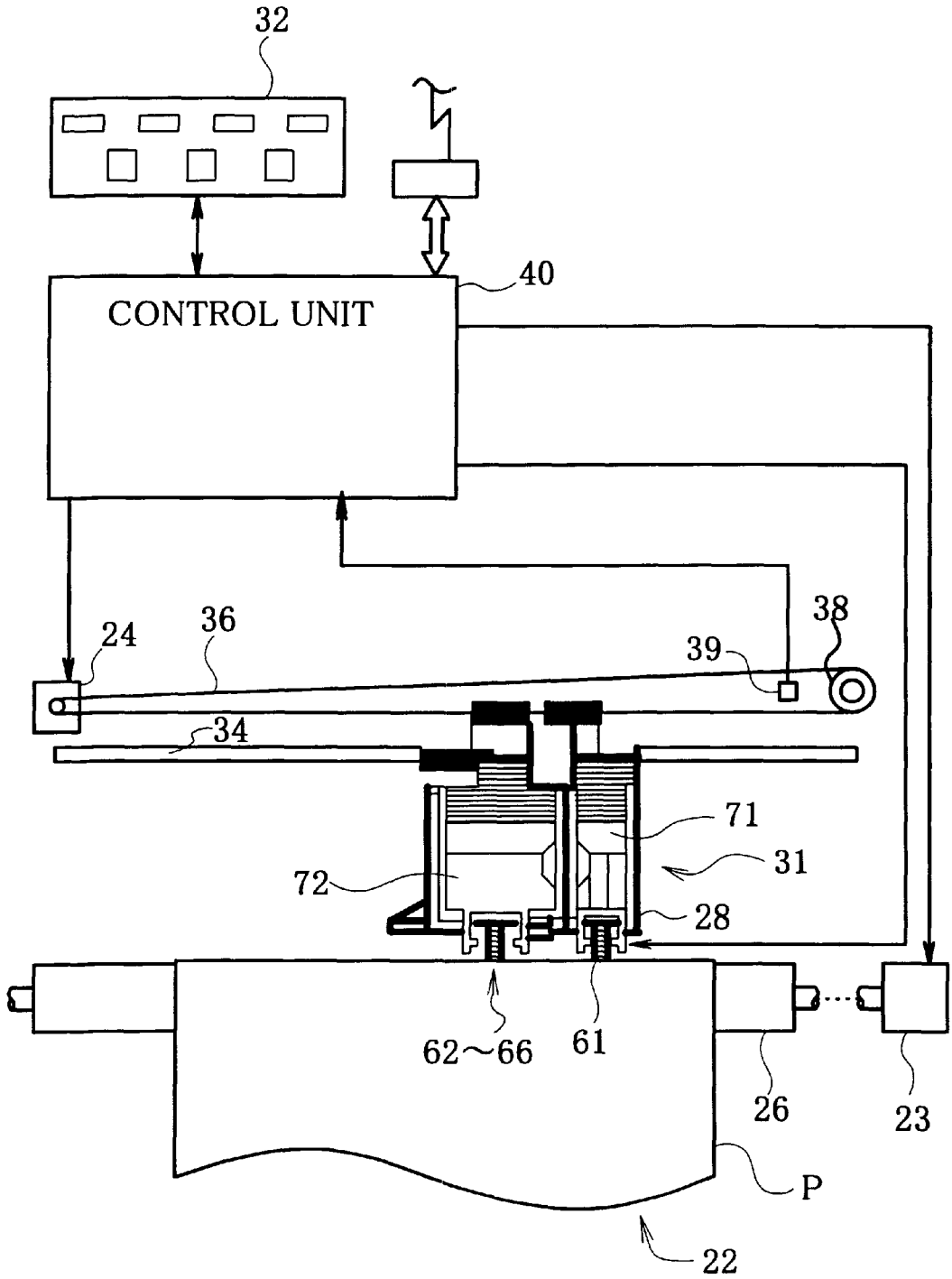
FIG. 3 schematically illustrates the structure of the printer PRT.

The structure of the printer PRT is described with reference to FIG. 3. The printer PRT has a circuit for driving a sheet feed motor 23 to feed a sheet of printing paper P, a circuit for driving a carriage motor 24 to move a carriage 31 forward and backward along an axis of a platen 26, a circuit for driving a print head 28 mounted on the carriage 31 to implement ink ejection and dot creation, and a control unit 40 that controls transmission of signals to and from the sheet feed motor 23, the carriage motor 24, the print head 28, and a control panel 32.

The circuit for reciprocating the carriage 31 along the axis of the platen 26 includes a sliding shaft 34 that is disposed in parallel with the axis of the platen 26 to slidably support the carriage 31, a pulley 38 that is combined with the carriage motor 24 to hold an endless drive belt 36 spanned therebetween, and a position sensor 39 that detects the position of the origin of the carriage 31.

A black ink cartridge 71 for black ink (K) and a color ink cartridge 72 in which five color inks (e.g., cyan (C), light cyan (LC), magenta (M), light magenta (LM), and yellow (Y)) are accommodated are detachably attached to the carriage 31 in the printer PRT. A total of six ink ejection heads 61 through 66 are formed on the print head 28 that is disposed in the lower portion of the carriage 31. Ink conduits 68 are formed in the bottom of the carriage 31 to lead supplies of inks from the ink reservoirs to the respective ink ejection heads.

Figure 4:
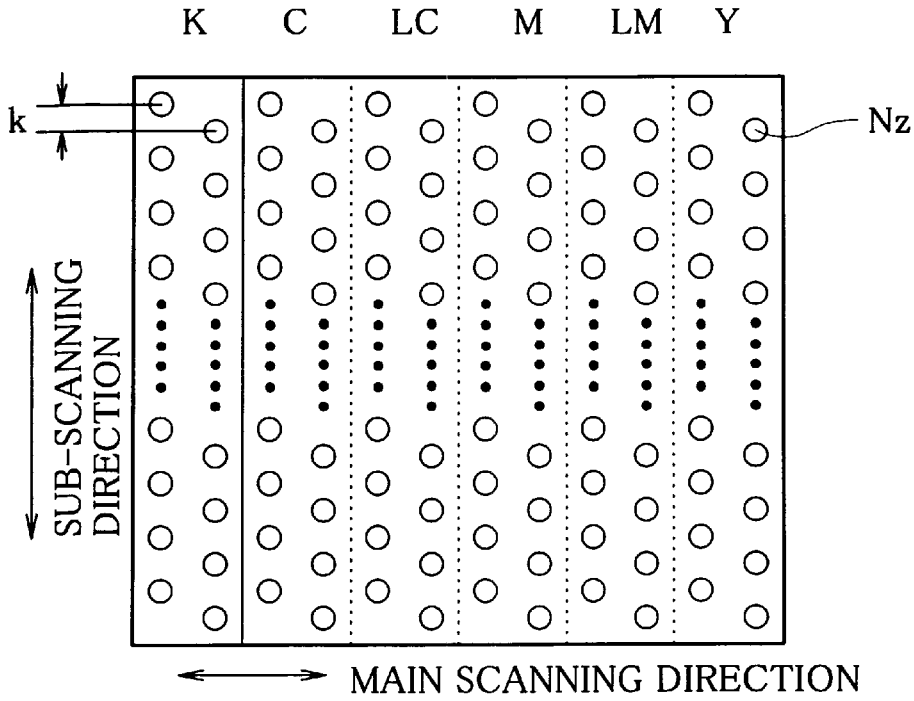
FIG. 4 shows an arrangement of nozzles Nz included in the ink ejection heads of the printer in FIG. 3.

FIG. 4 shows an arrangement of nozzles Nz in the respective ink ejection heads 61 through 66. The arrangement of nozzles shown in FIG. 4 includes six nozzle arrays respectively corresponding to the six color inks. Each nozzle array includes forty-eight nozzles Nz arranged in zigzag at a fixed nozzle pitch k. The positions of the corresponding nozzles in the respective nozzle arrays are coincident with one another in a sub-scanning direction.

Figure 5:
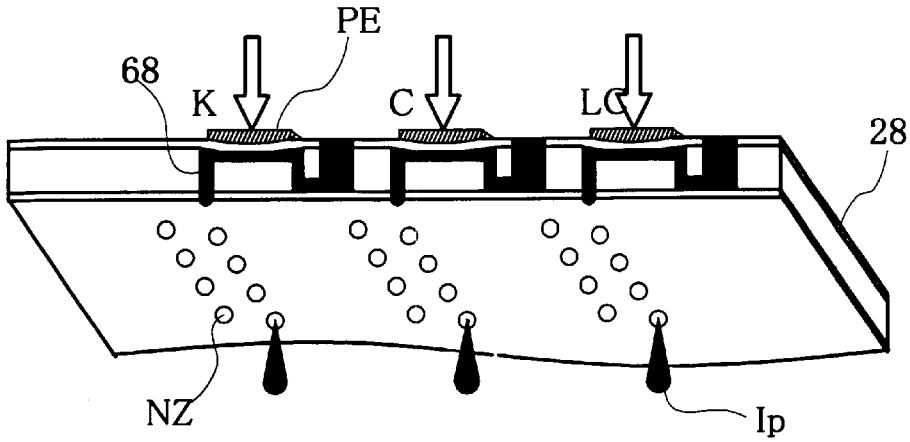
FIG. 5 shows the principle of dot creation by a print head.

FIG. 5 shows the principle of dot creation by the print head 28. For the clarity of illustration, only the part relating to the ejection of the three color inks, black (K), cyan (C), and light cyan (LC), is shown. When the ink cartridges 71 and 72 are attached to the carriage 31, the supplies of the respective color inks flow through the ink conduits 68 shown in FIG. 5 and are fed to the corresponding ink ejection heads 61 through 66.

In the ink ejection heads 61 through 66, a piezoelectric element PE is provided for each nozzle. As is known by those skilled in the art, the piezoelectric element PE deforms its crystal structure by application of a voltage and implements an extremely high-speed conversion of electrical energy into mechanical energy. When a preset voltage is applied between electrodes on either end of the piezoelectric element PE for a predetermined time period, the piezoelectric element PE is expanded for the predetermined time period to deform one side wall of the ink conduit 68 as shown by the arrows in FIG. 5. The volume of the ink conduit 68 is reduced according to the expansion of the piezoelectric element PE. Further, a certain amount of ink corresponding to the reduction is ejected as an ink particle Ip from the nozzle Nz at a high speed. The ink particles Ip soak into the printing paper P set on the platen 26, so as to implement printing.

Figure 6:
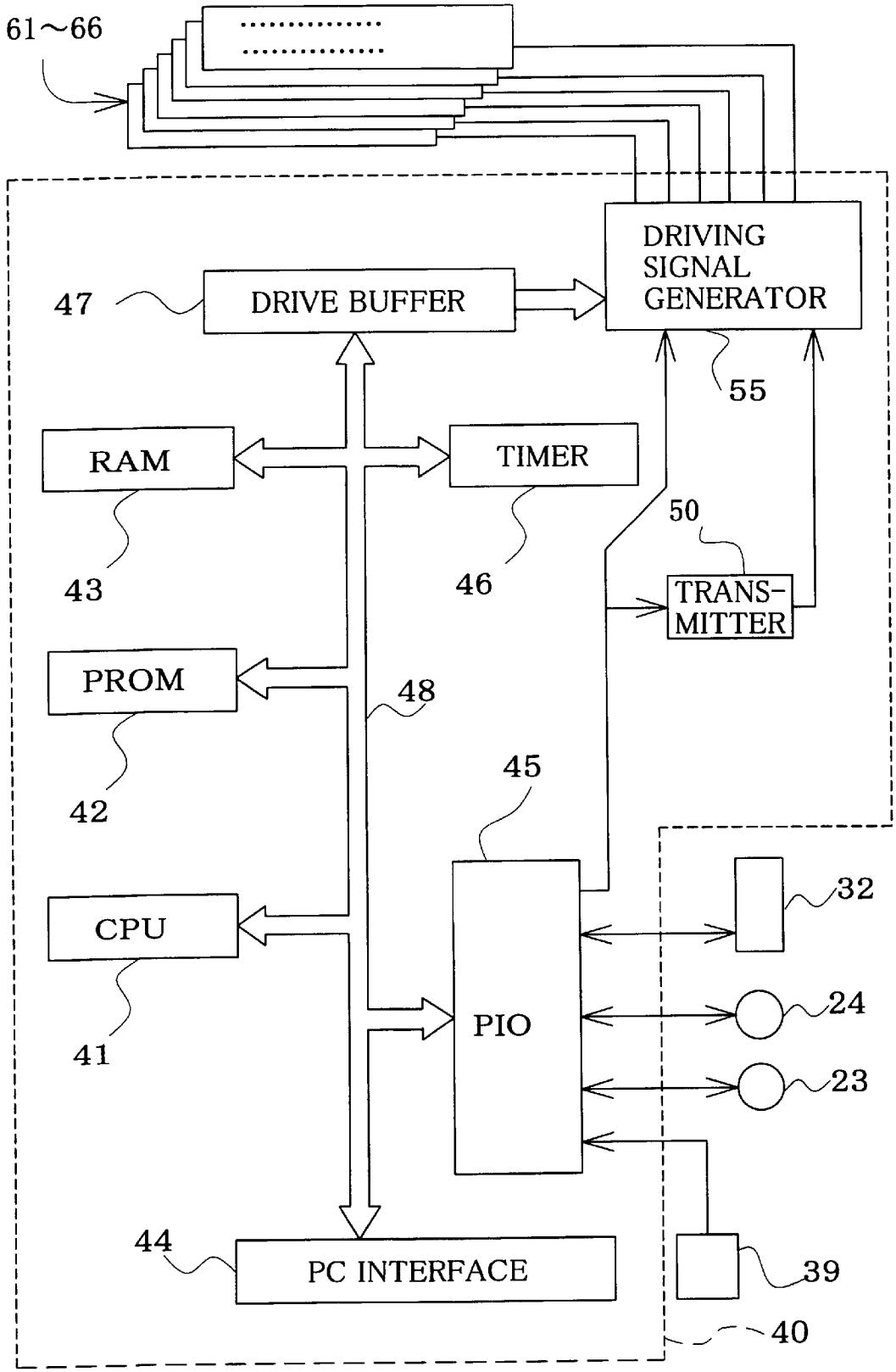
FIG. 6 shows the internal structure of a control unit included in the printer PRT.

The following describes the internal structure of the control unit 40, with reference to FIG. 6. The control unit 40 includes a CPU 41, a PROM 42, a RAM 43, and a diversity of other circuits discussed below, which are mutually connected via a bus 48. A PC interface 44 controls the transmission of data to and from the computer 90. A peripheral input-output unit (PIO) 45 controls the transmission of signals to and from the sheet feed motor 23, the carriage motor 24, and the control panel 32. In addition, a clock 46 synchronizes the operations of the respective circuits included in the control unit 40, and a drive buffer 47 activates a driving signal generator 55 to output signals representing the dot on-off state of the respective nozzles to the ink ejection heads 61 through 66.

Further, a transmitter 50 is connected to the driving signal generator 55. The transmitter 50 periodically outputs a clock signal, which works as a reference signal in the process of generating the driving signal. The driving signal generator 55 generates driving waveforms to be output to the respective nozzle arrays of the ink ejection heads 61 through 66, based on the clock signal output from the transmitter 50. As illustrated previously, the ink ejection heads 61 through 66 include the plurality of nozzle arrays having different positions in the main scanning direction. The driving signal generator 55 takes into account such a difference in position and outputs the driving signal at selected timings to adequately create dots in the respective pixels. Since the printer PRT adopts the technique of bidirectional recording, the output timings of the driving signal are set individually for the forward pass and the backward pass of the main scan and are stored in the PROM 42.

Figure 7:
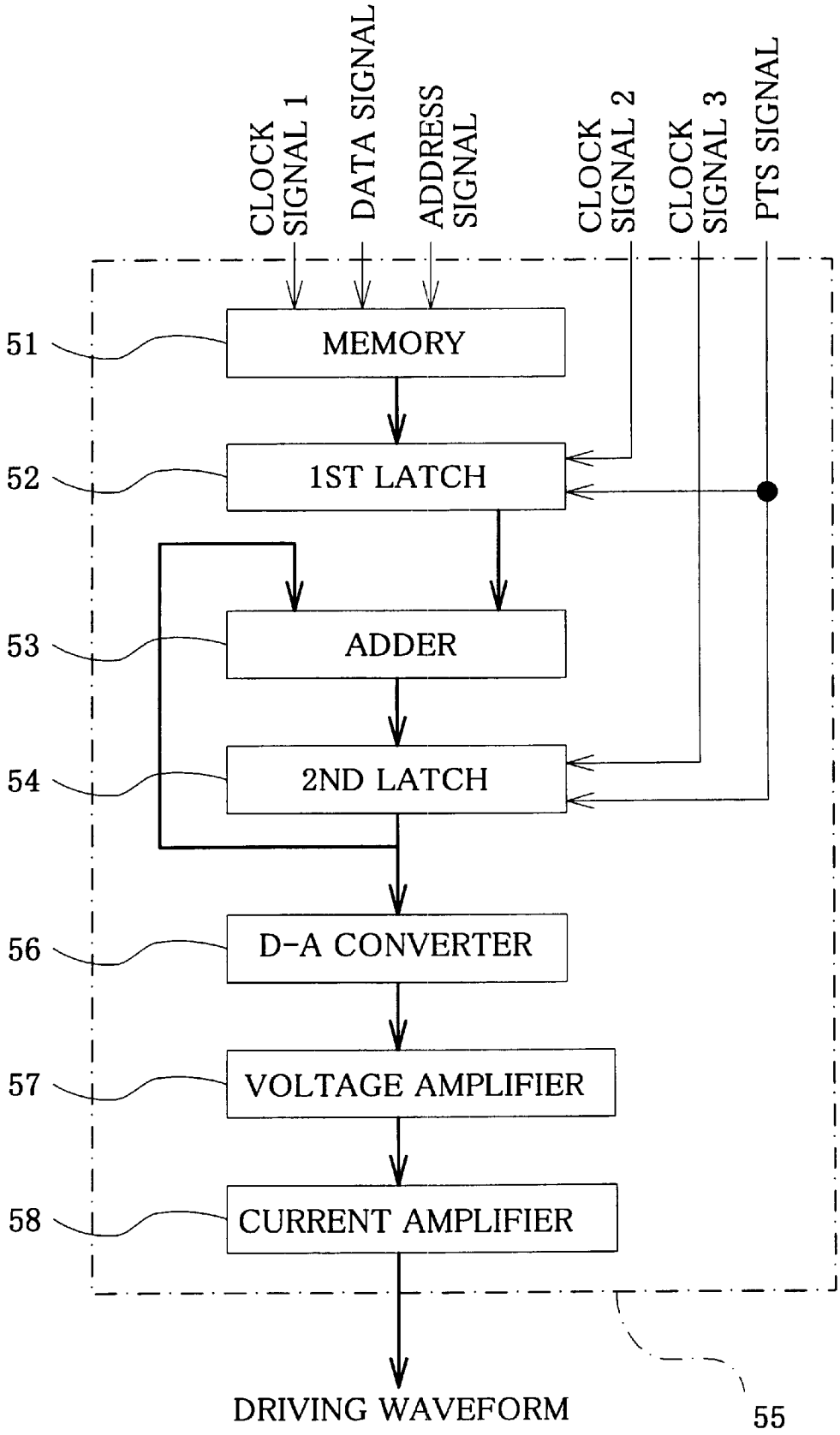
FIG. 7 shows the internal structure of a driving signal generator.

The following describes the generation of a driving waveform. In more detail, FIG. 7 shows the internal structure of the driving signal generator 55. The driving signal generator 55 includes a memory 51 that stores parameters for specifying the shape of the driving waveform, a first latch 52 that reads the storage contents of the memory 51 and temporarily holds the contents, an adder 53 that adds the output of the first latch 52 and the output of a second latch 54 discussed below, a D-A converter 56 that converts the output of the second latch 54 into analog data, a voltage amplifier 57 that amplifies the converted analog signal to a specific voltage amplitude for driving the piezoelectric element PE, and a current amplifier 58 that supplies an electric current corresponding to the amplified voltage signal. The memory 51 stores predetermined parameters for specifying the shape of the driving waveform. As shown in the drawing, clock signals 1, 2, and 3, a data signal, an address signal, and a PTS signal are input into the driving signal generator 55.

The clock signals 1, 2, and 3 represent three timing signals output from the transmitter 50. The clock signal 1 attains synchronization in the process of inputting the data signal into the memory 51. The clock signal 2 determines the timing to select and change over the working data used for generating the driving waveform among a plurality of slew rates stored in the memory 51. Further, the clock signal 3 controls a variation in a voltage of the driving waveform. The PTS signal is output corresponding to each pixel and indicates a start of output of the driving waveform. The PTS signal also specifies the input timings of data corresponding to the respective pixels from the drive buffer 47.

Figure 8:
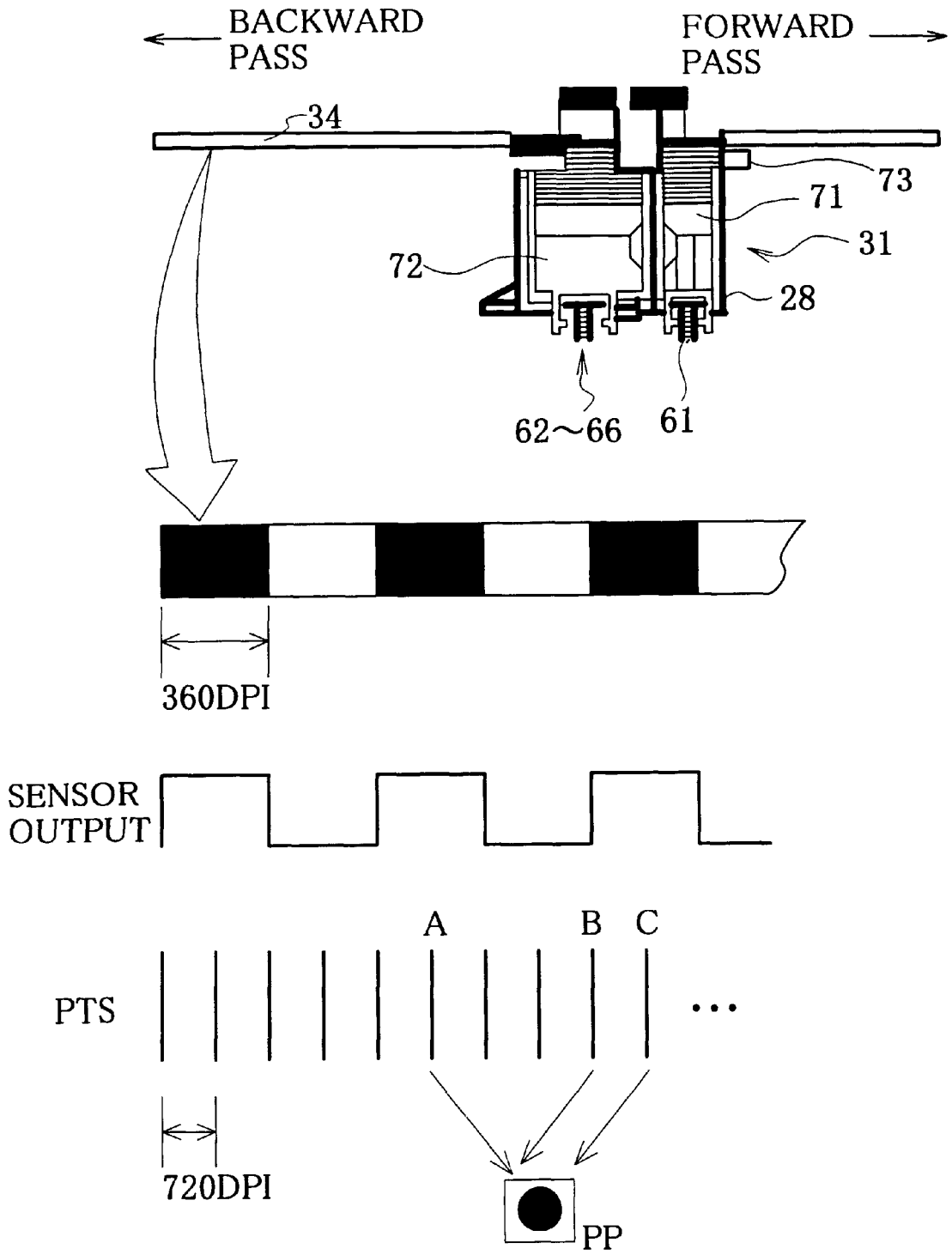
FIG. 8 shows generation of a PTS signal.

FIG. 8 shows generation of the PTS signal. In the printer PRT, the sliding shaft 34, which slidably supports the carriage 31, has a linear scale on which painted parts are arranged at preset equal intervals. In this example, the width of each painted part is equal to an interval of 360 dpi, which corresponds to twice the printing resolution of the printer PRT. An optical sensor 73 is mounted on the carriage 31 and outputs an on-off state signal according to the facing part (i.e., either the painted part or the open part faces the optical sensor 73) during movement of the carriage 31. The output signal from the optical sensor 73 is also shown in FIG. 8, and the control unit 40 detects the position of the carriage 31 in the main scanning direction based on this output signal (pulse).

The position of the carriage 31 may be specified with a greater resolution than the resolution of the painted part by equally dividing the pulse output from the optical sensor 73. For example, when the interval of the output pulse is divided into two equal parts, the position of the carriage 31 is specified with a resolution of 720 dpi. The resulting signal holds a fixed relationship between the carriage 31 and each pixel. For printing at the resolution of 720 dpi, the resulting signal functions as the PTS signal. FIG. 8 further shows an example of the PTS signal corresponding to the resolution of 270 dpi. Further, the method of generating the PTS signal is not restricted to the arrangement using the optical sensor. The PTS signal may alternatively be output at fixed time periods from the beginning of the main scan. The arrangement using the optical sensor, however, ensures generation of the signal having the higher accuracy.

Figure 9:
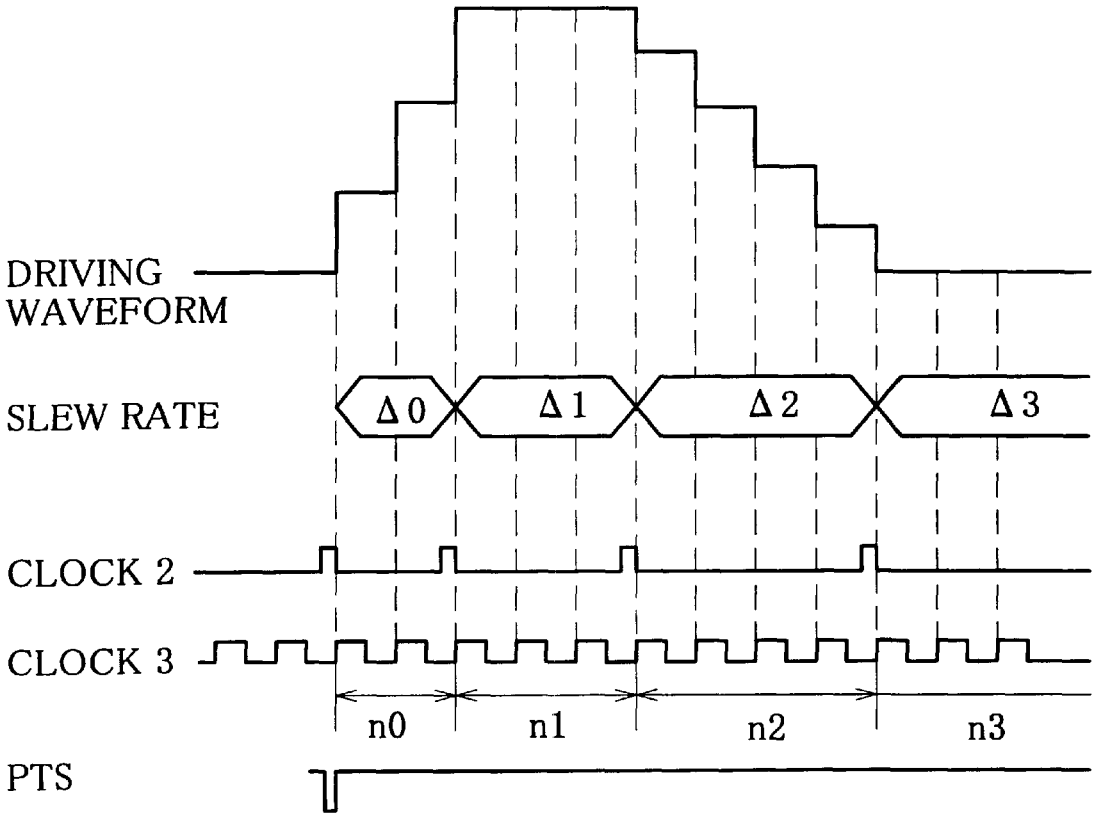
FIG. 9 shows a process of generating a driving waveform.

Turning now to FIG. 9, which shows a process of generating the driving waveform. Prior to generating the driving waveform, some pieces of data representing selected slew rates of the driving signal are sent to the memory 51. The slew rate represents a variation in voltage per unit time. The positive slew rate raises the voltage at a fixed rate of change, whereas the negative slew rate lowers the voltage at a fixed rate of change. At most 32 slew rates are stored at respective addresses in the memory 51. In this example, it is assumed that slew rates $\Delta 0$, $\Delta 1$, $\Delta 2$, $\Delta 3$, . . . are sequentially stored in the memory 51.

In response to specification of a first address when the PTS signal is input to start generation of the driving waveform, the slew rate $\Delta 0$ corresponding to the first address is read from the memory 51 and held in the first latch 52 synchronously with the clock signal 2. A summation obtained by successively accumulating the slew rate $\Delta 0$ in synchronism with the clock signal 3 is, on the other hand, held in the second latch 54. The voltage output from the second latch 54 thus varies stepwise as shown in FIG. 9. The output driving signal is subjected to waveshaping in the D-A converter 56 to have a smooth waveshape, is amplified by the voltage amplifier 57 and the current amplifier 58, and is output to each ink ejection head.

In response to an input of another pulse of the clock signal 2, the slew rate $\Delta 1$ corresponding to a second address is output from the first latch 52 to the adder 53. The voltage then has a change of rate corresponding to the slew rate $\Delta 1$. In this example, the slew rate $\Delta 1$ is equal to zero. The voltage is accordingly kept at a plateau in the division where the second address is set. A negative value is set to the slew rate $\Delta 2$ corresponding to a third address, and the voltage is accordingly lowered at the fixed rate in the division where the third address is set.

Periods of duration to sustain the respective slew rates are stored in combination with the slew rates in the memory 51. In the example of FIG. 9, a period of duration n0 is mapped to the slew rate $\Delta 0$, and another period of duration n1 is mapped to the slew rate $\Delta 1$. The period of duration is registered as the number of pulses of the clock signal 3 output in a time interval specified by the period of duration. The clock signal 2 is output at the intervals corresponding to the respective periods of duration.

Figure 10:
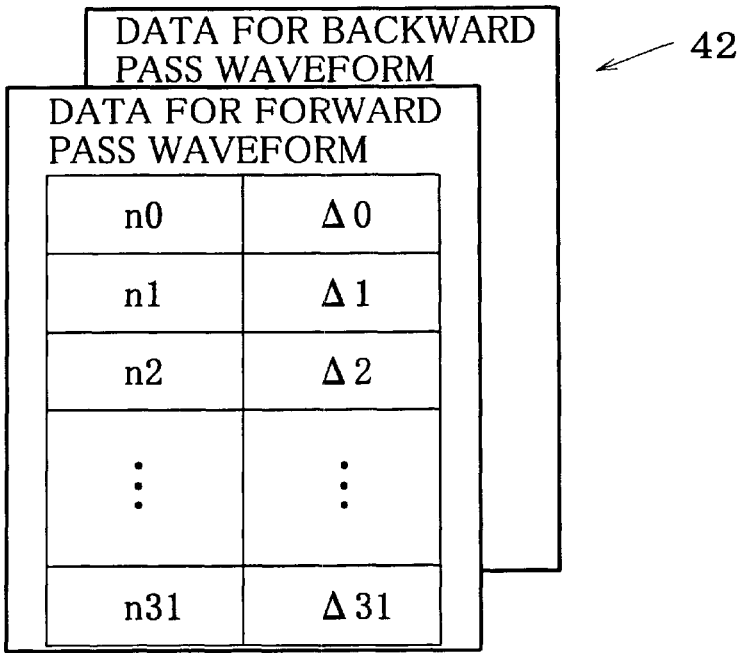
FIG. 10 shows an example of data for generating the driving waveform.

Appropriate transmission of the clock signal 2 to the driving signal generator 55 varies the voltage at predetermined rates of change and thereby completes a driving waveform. Varying the values stored in the memory 51 changes the shape of the driving waveform, results in varying the ink ejection timing. FIG. 10 shows an example of data for generating the driving waveform. In this example, slew rates $\Delta 0$ to $\Delta 31$ and periods of duration n0 to n31 mapped thereto are stored in the PROM 42. In the case of bidirectional recording, the forward pass and the backward pass of the main scan have different ink ejection timings. Thus, data for the forward pass waveform and data for the backward pass waveform are stored individually. The waveform data are also stored individually for the respective ink ejection heads 61 through 66.

This arrangement varies the shape of the driving waveform in the above manner and thus enables the printer PRT to create three variable dots having different ink weights. The dot having the greatest quantity of ink, the dot having the intermediate quantity of ink, and the dot having the smallest quantity of ink are respectively referred to as a large-sized dot, a medium-sized dot, and a small-sized dot.

Figure 11:
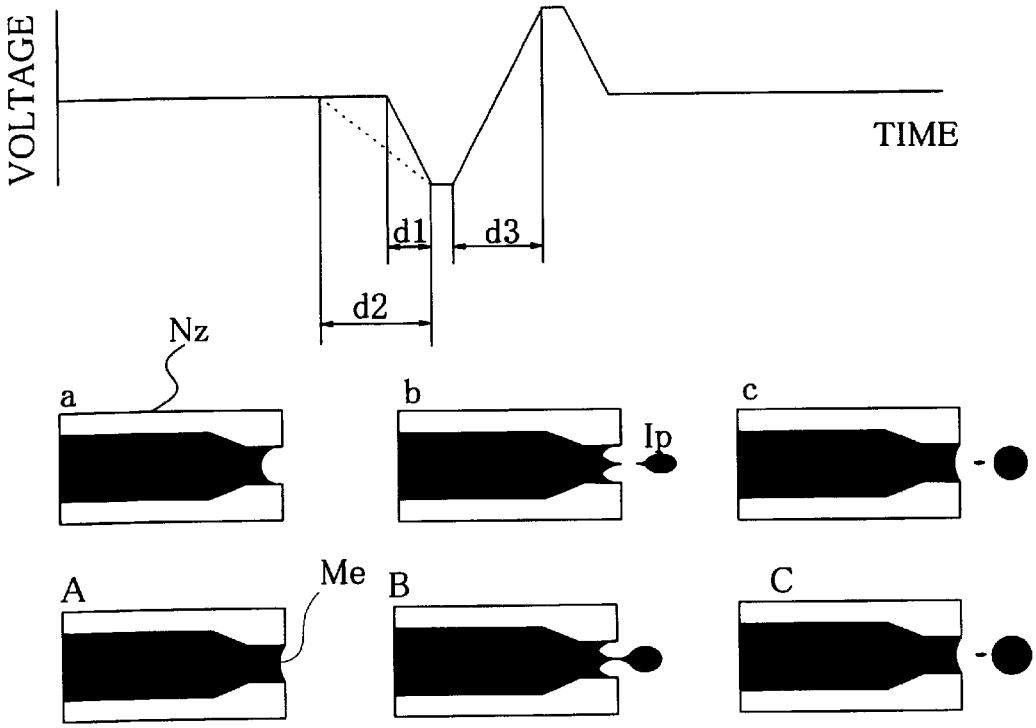
FIG. 11 shows the relationship between the driving waveform and the size of an ink particle ejected from a nozzle.

The principle of creating these three variable dots is described below. In more detail, FIG. 11 shows the relationship between the driving waveform and the size of the ink particle Ip ejected from the nozzle Nz. The driving waveform shown by the broken line in FIG. 11 represents a voltage waveform applied to create standard-sized dots. A decrease in potential of the piezoelectric element PE in a division d2 deforms the piezoelectric element PE in the direction of increasing the cross section of the ink conduit 68. The rate of deformation is higher than the rate of ink supply from the ink conduit 68, so that an ink interface Me called meniscus is slightly concaved inward the nozzle Nz as shown in a state A of FIG. 11. An abrupt decrease in potential in a division d1, which follows the driving waveform shown by the solid line in FIG. 11, further enhances the rate of deformation of the ink conduit 68. The meniscus is thus concaved more significantly (state 'a'), compared with the state A. A subsequent increase in voltage applied to the piezoelectric element (division d3) causes ink to be ejected. As shown in states B and C, a large ink droplet is ejected from the meniscus only slightly concaved inward (the state A). As shown in states 'b' and 'c', on the other hand, a small ink droplet is ejected from the meniscus significantly concaved inward (the state 'a').

Figure 12:
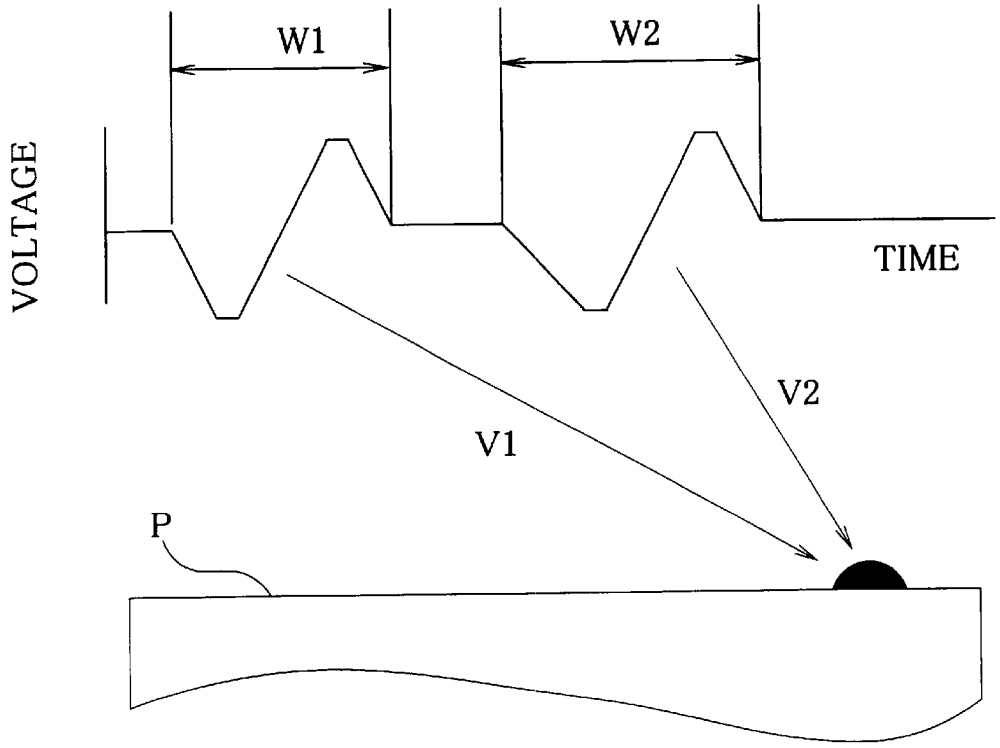
FIG. 12 shows a shape of the driving waveform.

The weight of ink ejected from the nozzle is varied according to the rate of change in the course of decreasing the potential of the piezoelectric element PE (see the divisions d1 an d2), that is, according to the driving waveform applied to drive the nozzle. FIG. 12 shows the shape of the driving waveform used in this example. The technique of this example uses two different driving waveforms, that is, a driving waveform W1 used to create the small-sized dot and a driving waveform W2 used to create the medium-sized dot. The driving waveforms W1 and W2 are output at a specific interval that enables the respective dots to be created in each pixel in the course of shifting the carriage 31. In the arrangement of this example, the greater weight of ink generally has the higher flight velocity. In the printer PRT, the flight velocities are regulated to make the small-sized dot and the large-sized dot hit against substantially identical positions on the printing paper P. The large-sized dot is created by ejecting ink droplets in response to both the driving waveforms W1 and W2.

Figure 13:
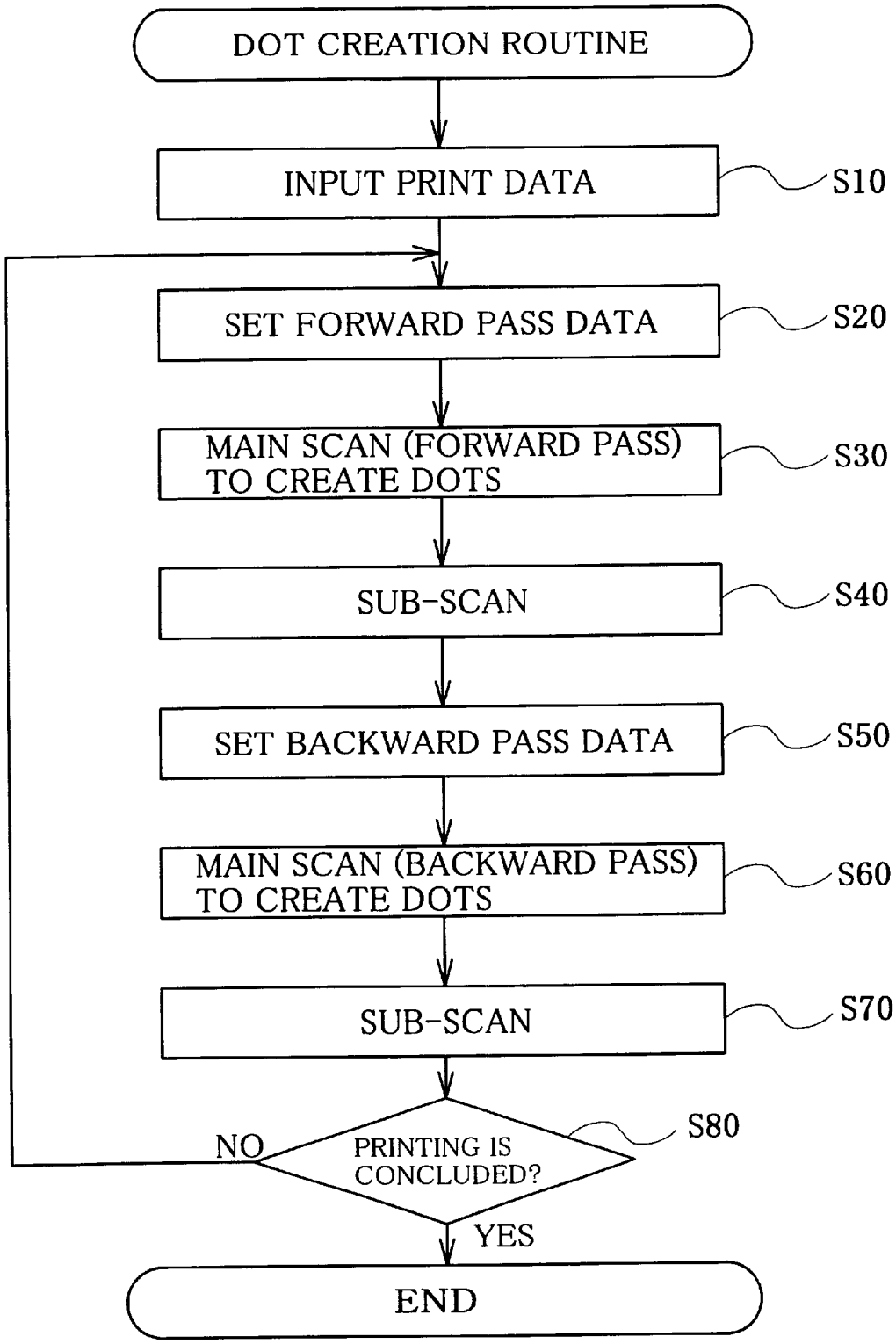
FIG. 13 is a flowchart showing a dot creation routine.

The following describes a series of control process performed when the printer PRT prints an image. In more detail, FIG. 13 is a flowchart showing a dot creation routine, which is executed by the CPU 41 included in the control unit 40 of the printer PRT in response to an instruction transmitted from the printer driver 96. The description corresponds to the case of bidirectional recording. The printer PRT is also capable of creating dots only in passes of a specific direction according to a specified print mode.

When the program enters the routine, the CPU 41 first inputs print data (step S10). The print data, which has undergone the processing executed in the printer driver 96, specifies the dot on-off state in each pixel with regard to the variable dots and the respective colors.

The CPU 41 subsequently sets forward pass data, based on the input print data (step S20). More concretely, the procedure transfers the forward pass data, which specifies the on-off state of dots to be created in the forward pass of the main scan, to the drive buffer 47. After setting the forward pass data, the CPU 41 moves the carriage 31 forward as the forward pass of the main scan to create dots (step S30). Because the printer PRT has 48 nozzles provided for each color, this process accordingly forms 48 raster lines.

The CPU 41 then performs one pass of a sub-scan (step S40), which feeds the printing paper by a specific feeding amount set in advance according to the print mode. The CPU 41 subsequently sets backward pass data in the drive buffer 47 (step S50). To shorten the processing time, the process of setting the backward pass data is performed partly in parallel with the sub-scan. After setting the backward pass data, the CPU 41 moves the carriage 31 backward as the backward pass of the main scan to create dots (step S60), and performs another pass of the sub-scan (step S70). This series of processing is repeatedly executed until conclusion of printing (step S80), that is, until the end of the input print data.

There are a diversity of applications of the bidirectional recording. For example, each raster line may be formed in only one of the forward pass and the backward pass. In another example, only part of each raster line may be formed by one pass of the main scan. The sub-scan with a specific feeding amount causes a plurality of nozzles to be allocated to one raster line and enables each raster line to be completed by plural passes of the main scan. In addition, the printing process may be changed by varying the feeding amount of sub-scan according to the specified print mode.

Figure 14:
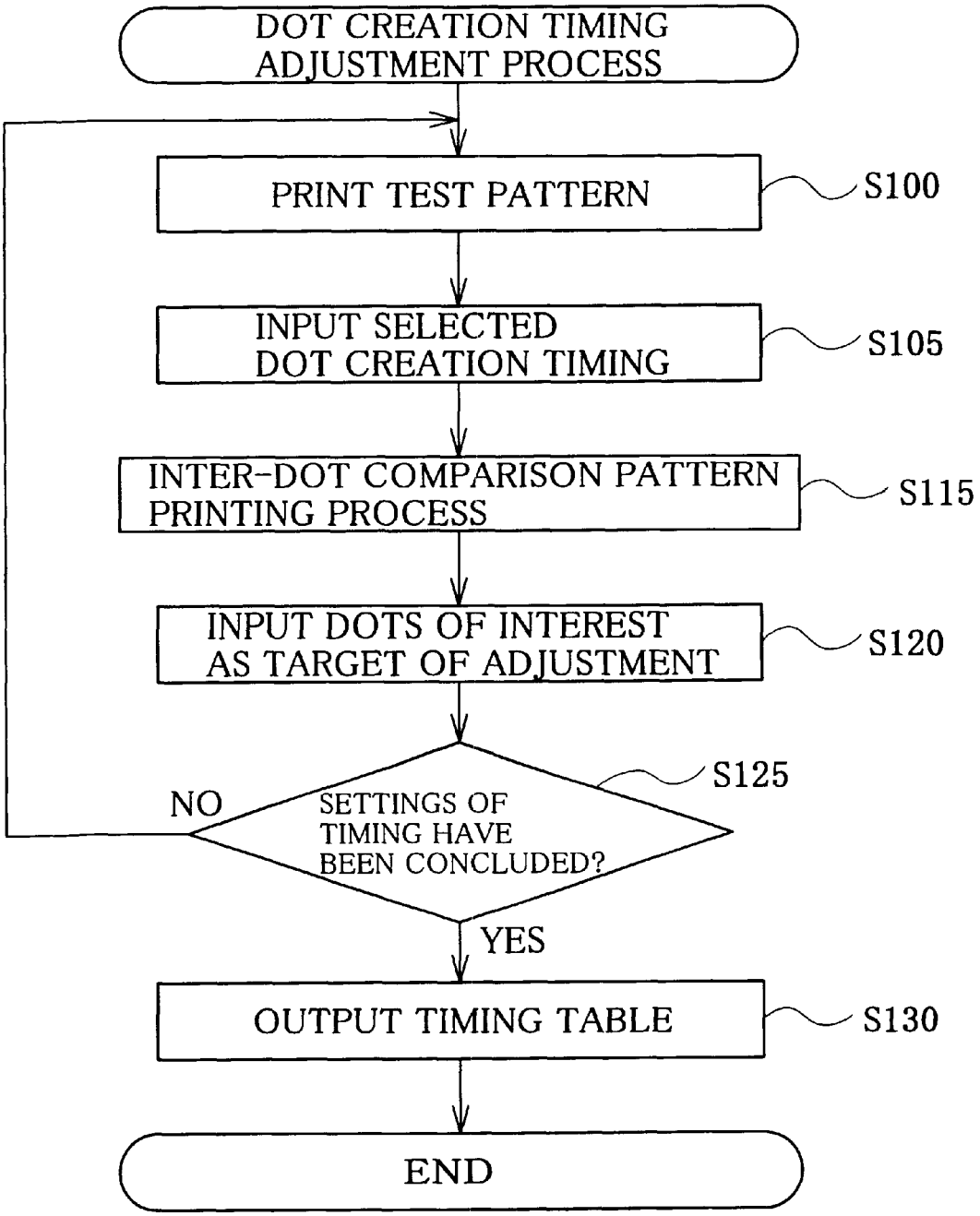
FIG. 14 is a flowchart showing a dot creation timing adjustment process.

The printing system according to the present invention is capable of adjusting the creation timing of each dot. The following description regards a process of adjusting the dot creation timing in the case of bidirectional recording. The printer driver 96 performs a dot creation timing adjustment process to implement the adjustment. FIG. 14 is a flowchart showing the dot creation timing adjustment process, which is executed by the CPU 81 in the computer 90. The procedure of this example adjusts the creation timings of the large-sized dot, the medium-sized dot, and the small-sized dot with regard to the respective colors, black (K), cyan (C), light cyan (LC), magenta (M), light magenta (LM), and yellow (Y).

The following description is on the assumption that black is selected as the reference color and the large-sized dot is selected as the reference dot. Further, the reference color and the reference dot represent the ink and the variable dot used as the standard for adjusting the dot creation timing. The method of selection will be discussed later. When the program enters the dot creation timing adjustment process, the CPU 81 first adjusts the creation timing of the reference dot in the reference color, that is, the large-sized dot in black (K). For this purpose, the CPU 81 causes a test pattern for the large-sized dot in K to be printed (step S100). The data for printing the test pattern has been stored in advance in the memory. In addition, the data for printing the test pattern is output to the printer PRT, and a predetermined test pattern is then printed by the procedure discussed above with the flowchart of FIG. 13.

Figure 15:
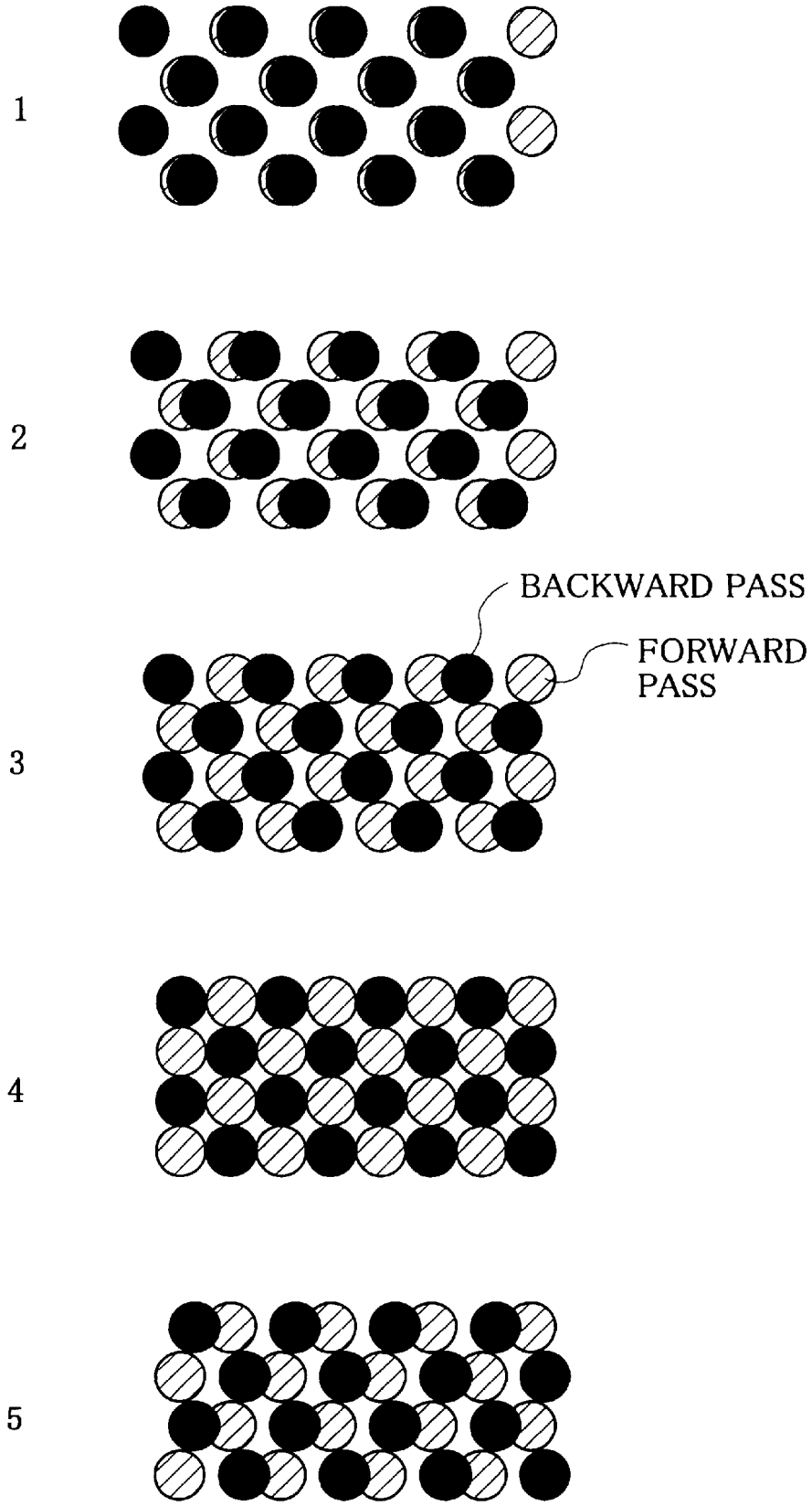
FIG. 15 shows a printed test pattern.

FIG. 15 shows a printed test pattern. Here the hatched circles represent the dots created in the forward pass of the main scan, whereas the closed circles represent the dots created in the backward pass of the main scan. The procedure prints the test pattern while varying the dot creation timing in the backward pass in five different stages expressed by numerals 1 through 5 relative to the dot creation timing in the forward pass. The dot creation timing is varied with the selection of the PTS and the relationship between the selected PTS and the position of dot creation is shown in FIG. 8. For example, it is assumed that ink is ejected at the PTS defined as A to create a dot in a pixel of interest PP in the forward pass of the main scan where the carriage 31 moves from left to right. To create a dot in the same pixel of interest PP in the backward pass, it is essential to select the appropriate PTS by taking into account the shifting direction of the carriage 31. As clearly shown in the drawing, when ink is ejected at the PTS defined as B, a dot is created at a position deviated from the pixel of interest PP. When ink is ejected at the PTS defined as C, on the other hand, a dot is created in the pixel of interest PP. Regulating the PTS relative to the pixel according to the ejection speed of ink enables adjustment of the position of dot creation. Part of the test pattern results from the varying selection of the PTS.

The dot creation timing is also adjusted by varying the driving waveform. The selection of the PTS only adjusts the position of dot creation by the unit of the pixel width. An arrangement of outputting the PTS at the frequency of not lower than the resolution with high accuracy is required for a finer adjustment than the pixel width. The technique of this example accomplishes such a fine adjustment by varying the driving waveform. In addition, the driving waveform used in the printer PRT is variable to a diversity of shapes by the combination of the slew rate with the period of duration as previously discussed with FIGS. 9 and 10. The dot creation timing may be varied arbitrarily by varying these parameters and thereby change the time periods between the output of the PTS signal and the output of the driving waveforms W1 and W2. In response to an instruction to print the test pattern, the CPU 41 in the control unit 40 creates dots using a plurality of driving waveforms that have been set in advance to supplement the adjustment of the dot creation timing by the selection of the PTS. The test pattern shown in FIG. 15 is obtained by varying the dot creation timing stepwise in the backward pass according to the two procedures discussed above and thereby causing the dot recording positions in the backward pass of the main scan to be shifted leftward and rightward relative to the dot recording positions in the forward pass.

The test pattern may be any of various patterns that enable detection of a difference between the dot creation timing in the forward pass and the dot creation timing in the backward pass. Here the dots created in the forward pass and the dots created in the backward pass are arranged in a checker pattern as shown in the drawing. In this pattern, the respective dots are expected to be substantially in contact with their adjoining dots. In the example of FIG. 15, the dots with No. 4 allocated thereto correspond to the test pattern printed at the optimum dot creation timing. The checker pattern is preferably applied since even a slight positional misalignment of dots is detectable with a relatively high accuracy in this pattern. In this pattern, any deviation of the positions of dot creation causes dropouts. The appearance of the dropouts of a fixed pattern in a predetermined area makes the varying color shade recognizable. These functions enable the positional misalignment of dots to be detected with high accuracy.

Then, the user of the printer PRT checks the test pattern printed in the above manner and selects a recorded image of the optimum conditions. The CPU 81 then inputs a value allocated to the selected dot creation timing (step S105). In the example of FIG. 15, the value '4' is input as the optimum dot creation timing, and the input data is temporarily stored in the form of a timing table in the memory of the computer PC. This series of processing completes the adjustment of the dot creation timing in the backward pass relative to the dot creation timing in the forward pass with regard to the large-sized dot in black (K).

Figure 16:
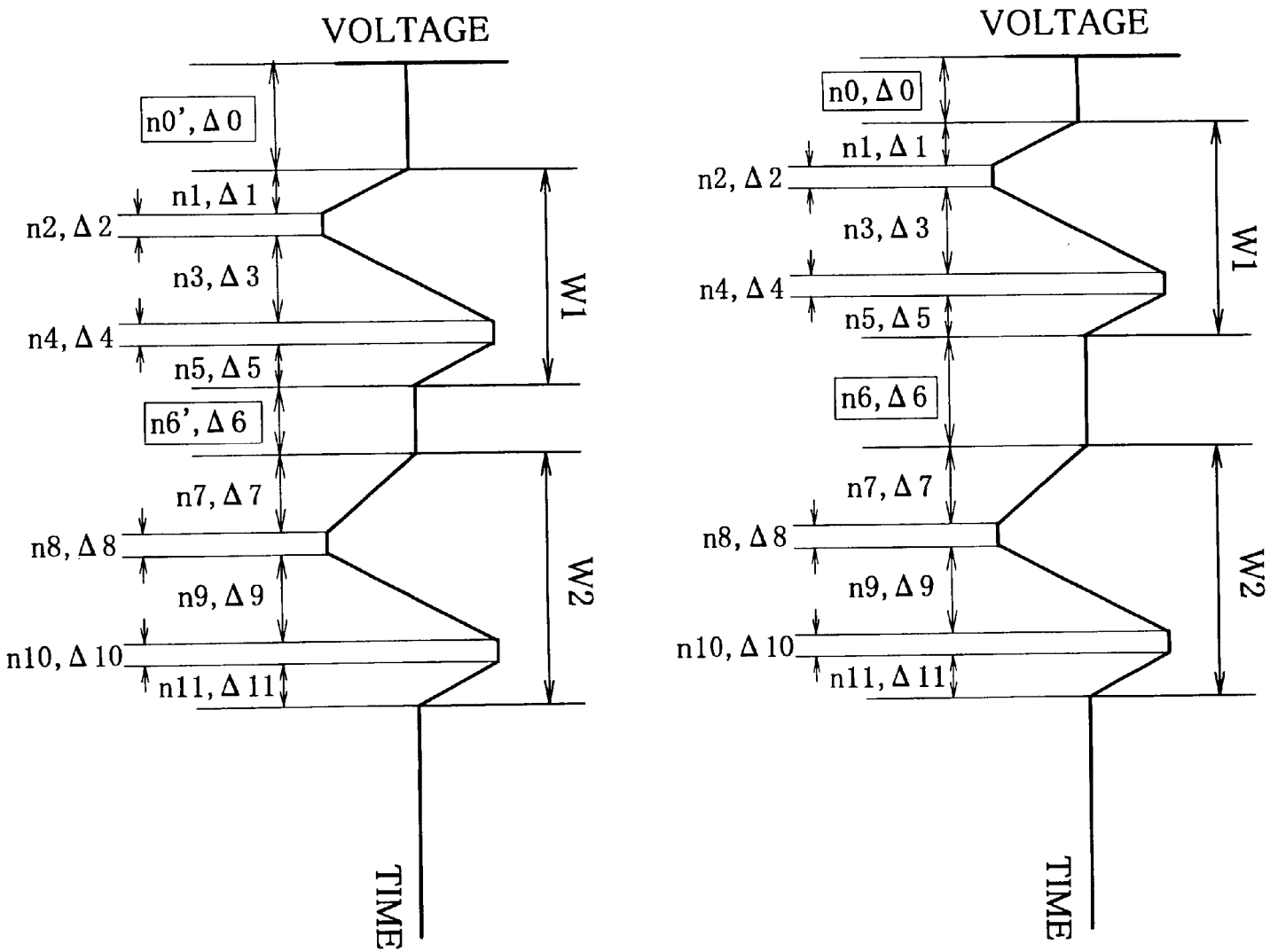
FIG. 16 shows a variation in a driving waveform before and after adjustment of the dot creation timing.

The following describes the details of the procedure of adjusting the dot creation timing. In more detail, FIG. 16 shows a variation in a driving waveform before and after adjustment of the dot creation timing. Here the PTS signal is selected to make the position of dot creation closest to each original pixel. In this example, after the selection of the PTS signal in this manner, the driving waveform is varied for an additional fine adjustment. The upper row shows the driving waveform prior to the adjustment. Further, the printer PRT successively outputs the two different driving waveforms W1 and W2. These driving waveforms are specified by the combination of the slew rates with the periods of duration as the parameters, as discussed previously. The graph shows a variation in a voltage related to these parameters in response to the output of the PTS signal. Here $\Delta 0$, $\Delta 1$, . . . denote slew rates, and n0, n1, . . . denote periods of duration.

The voltage is kept zero during a time interval corresponding to a period of duration n0 after the output of the PTS signal. Namely, the slew rate $\Delta 0$ is equal to zero. The slew rate $\Delta 1$ takes a negative value during a subsequent period of duration n1. The driving signals W1 and W2 are generated by the combination of the periods of duration n0 through n11 with the slew rates $\Delta 0$ through $\Delta 11$. As clearly understood from the drawing, the output timing of the driving waveform W1 after the output of the PTS signal is adjustable by varying the data representing the period of duration n0. In addition, the interval between the driving waveforms W1 and W2 is adjustable by varying the data representing the period of duration n6. The lower row of FIG. 16 shows the driving waveform after the adjustment. In this example, the period of duration n0 is elongated, whereas the period of duration n6 is shortened. Varying the data representing these periods of duration n0 and n6 enables regulation of the output timings of the driving waveforms and thereby adjustment of the positions of dot creation.

In the example of FIG. 15, the pattern with No. 4 allocated thereto is selected as the dot creation timing with regard to black. When the dot creation timing before the selection corresponds to the pattern with No. 3 allocated thereto, it is required to shift the positions of dots created in the backward pass rightward by one stage. Since the carriage moves from right to left in the backward pass, this requirement corresponds to the process of advancing the dot creation timing by one stage. The CPU 81 accordingly decrease the value set to the period of duration n0 by one stage among the contents of the parameters relating to the driving waveform used in the backward pass with regard to the black ink. It is not necessary to change the interval between the driving waveforms W1 and W2, when adjusting the dot creation timing with regard to the large-sized dot. The period of duration n6 is thus not varied here. The dot creation timing with regard to the large dot is adjusted by varying the value set to the period of duration n0 according to a relative shift from the previous dot creation timing.

In the printer PRT, it is required to adjust the dot creation timings in the backward pass and in the forward pass as well as the dot creation timings among different dots, with regard to the variable-size dots (i.e., the large-sized dot, the medium-sized dot, and the small-sized dot) in respective colors. One possible procedure successively sets the dot creation timings for all the variable dots in a preset order. This procedure, however, requires an extremely diverse adjustment, which is burdensome. However, some of the dot creation timings do not require any specific adjustment. Thus, to alleviate the load in the process of adjusting the dot creation timing, the procedure of this example selects dots of interest, which are to be subjected to the adjustment of the dot creation timing, and performs adjustment of the dot creation timing only for the selected dots.

Figure 17:
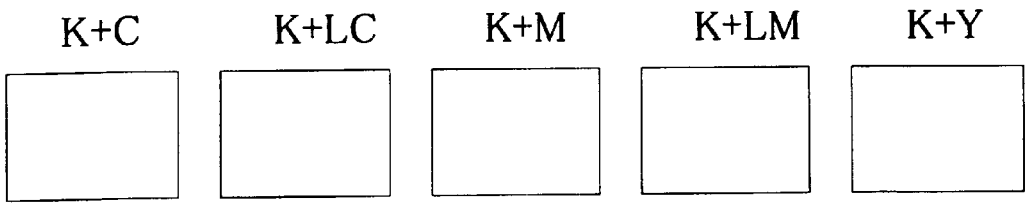
FIG. 17 shows an example of inter-dot comparison patterns.

The CPU 81 accordingly performs an inter-dot comparison pattern printing process (step S115 in FIG. 14), which allows the user to select the target of adjustment, which is to be subjected to the adjustment of the dot creation timing. In more detail, FIG. 17 shows an example of inter-dot comparison patterns. The inter-dot comparison pattern printing process prints the test patterns of FIG. 15 with dots of the black ink, which has undergone the adjustment of the dot creation timing, and other inks. For example, in the inter-dot comparison pattern 'K+C' of FIG. 17, black dots are created in the forward pass at the positions of the hatched circles in FIG. 15, whereas cyan (C) dots are created in the forward pass at the positions of the closed circles. In a similar manner, the inter-dot comparison patterns 'K+LC', 'K+M', 'K+LM', and 'K+Y' respectively include light cyan (LC) dots, magenta (M) dots, light magenta (LM) dots, and yellow (Y) dots created in the forward pass, in addition to the black dots created in the forward pass.

The user selects the dots as the target of adjustment of the dot creation timing based on the printed results. When an ink has the dot creation timing in the forward pass different from that of the black ink, some dropouts or varying color shades are visually recognized in the inter-dot comparison pattern. The resulting print also has a rough touch. The user selects such inks as the target of adjustment. Then, the CPU 81 inputs the selected target of adjustment (step S120).

The CPU 81 subsequently determines whether or not the settings of the dot creation timing have been concluded (step S125). When there is a target adjustment specified at step S120, it means the settings of the dot creation timing have not yet been concluded. The program accordingly returns to step S100 and performs the series of the processing to adjust the dot creation timing regarding the specified target of adjustment. When there is no target adjustment specified at step S120, on the other hand, the answer of the decision point S125 depends upon the inter-dot comparison patterns printed in the inter-dot comparison pattern printing process. When the inter-dot comparison patterns are printed for the comparison between the black ink and other color inks as shown in FIG. 17, it is determined the settings of the dot creation timing have not yet been concluded even with no specification of the target adjustment at step S120. The reason of such decision will be discussed later.

The CPU 81 then performs the series of processing to adjust the dot creation timing in the forward pass with regard to the specified ink. In the following description, it is assumed that two color inks; cyan and light cyan, are specified as the object of the adjustment. The CPU 81 prints the test patterns of FIG. 15 with regard to these inks (step S100). Each of the test patterns printed here is a checkerwise arrangement including black dots created in the forward pass and cyan or light cyan dots created in the forward pass. The dot creation timing is varied in five different stages with regard to the cyan dots and the light cyan dots. The method of varying the dot creation timing for these specified colors is a little different from the method applied for the reference color. Further, the selection of the PTS signal relative to the pixel is also changed in the case of the reference color. The selection of the PTS signal relative to the pixel has already been fixed in the process of adjusting the dot creation timing for the reference color. In the process of adjusting the dot creation timing for the colors other than the reference color, the time interval between the output of the PTS signal and the output of the driving waveform is varied, while the selection of the PTS is fixed.

Figure 18:
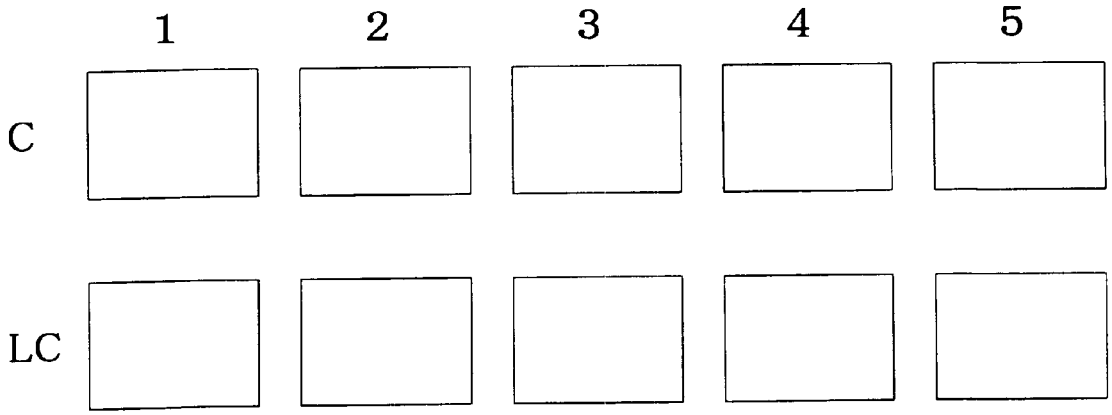
FIG. 18 shows test patterns printed in two specified colors.

FIG. 18 shows test patterns printed in the specified two colors. The cyan and light cyan test patterns following the arrangement of FIG. 15 may be printed individually. The procedure of this example, however, prints the test patterns in an arrangement of different dot creation timings in the main scanning direction and of different colors in the sub-scanning direction as shown in FIG. 18. The user selects the optimum dot creation timing individually for cyan and light cyan based on the printed results. In addition, the CPU 81 inputs the specified dot creation timings (step S105) and temporarily stores the input timings in the form of the timing table. The CPU 81 also varies the value set to the period of duration n0 in the forward pass among the parameters of the driving waveform with regard to each color, according to the specified dot creation timing as discussed previously with FIG. 16.

The above series of processing accomplishes the adjustment of the dot creation timings of other colors relative to the dot creation timing of black. The following description corresponds to the relationship between the variable dots to be subjected to the adjustment of the dot creation timing in the printer PRT and the dots that have already undergone such adjustment. In more detail, FIG. 19 shows the variable dots that are to be subjected to the adjustment of the dot creation timing in the printer PRT. The printer PRT is capable of creating the large-sized dot, the medium-sized dot, and the small-sized dot in the respective colors of black (K), cyan (C), light cyan (LC), magenta (M), light magenta (LM), and yellow (Y). In the map of FIG. 19, the vertical column shows the dots created in the forward pass, and the horizontal row shows the dots created in the backward pass. For convenience of illustration, the dots in only part of the inks are shown in FIG. 19. Strictly speaking, it is desirable to adjust the dot creation timing with regard to all the combinations of dots in both the forward pass and the backward pass, that is, with regard to the combinations corresponding to all the boxes in the map of FIG. 19.

In practice, however, adjustment of the dot creation timing with regard to each of the variable dots substantially cancels the difference among the variable dots. Similarly, there is little necessity of performing the adjustment for all the combinations of different colors. The adjustment of the dot creation timing for typical dots would be sufficient. The procedure of this example performs the adjustment among different colors using the reference dot, that is, the large-sized dot. Based on these ideas, the hatched boxes in the map of FIG. 19 do not require the adjustment of the dot creation timing, although the adjustment may be performed for the combinations corresponding to the hatched boxes.

The procedure of this example first adjusts the dot creation timing between the forward pass and the backward pass with regard to the large-sized dot in black as discussed previously. This corresponds to the combination No. 1 in the map of FIG. 19. The procedure then adjusts the dot creation timing between black and other colors with regard to the large-sized dot in the above example. This corresponds to the combinations No. 2 in the map of FIG. 19. In the above example, the adjustment of the dot creation timing between different colors is performed using only the dots created in the forward pass. Since the adjustment of the dot creation timing between the forward pass and the backward pass has been completed for black, this process is equivalent to the combinations No. 2 in FIG. 19.

As clearly understood from the map of FIG. 19, the above series of processing has not yet finished the adjustment of the dot creation timing between the forward pass and the backward pass with regard to the large-sized dot in colors other than black, nor the adjustment of the dot creation timing with regard to the medium-sized dot and the small-sized dot. The presence of such uncompleted part is the reason why it is determined at step S125 in the flowchart of FIG. 14 that the settings of the dot creation timing have not yet been concluded even when no specification of ink when the inter-dot comparison patterns (see FIG. 17) are printed between black and other colors. The CPU 81 again performs the inter-dot comparison pattern printing process (step S115) to perform the adjustment of the uncompleted part. The procedure of this example accordingly performs the adjustment of the dot creation timing between the forward pass and the backward pass with regard to the large-sized dot in color inks other than the black ink. This corresponds to the combinations No. 3 in the map of FIG. 19.

Figure 20:
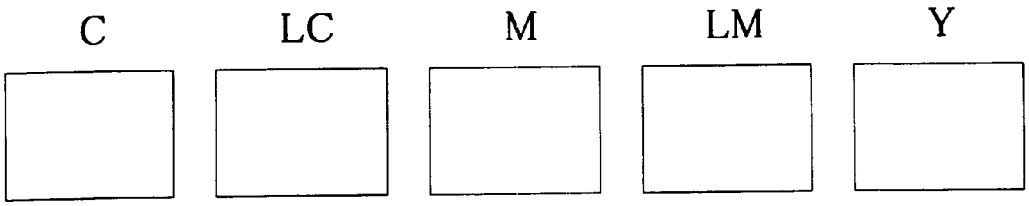
FIG. 20 shows an example of the inter-dot comparison patterns filled with the large-sized dots in the respective inks.

Turning now to FIG. 20, which shows an example of the inter-dot comparison patterns filled with the large-sized dots in the respective inks. The test pattern of FIG. 15 is printed with the large-sized dots created in the forward pass and the large-sized dots created in the backward pass with regard to each of the color inks, cyan, light cyan, magenta, light magenta, and yellow. A rough touch is observed in the color having a significant difference between the dot creation timing in the forward pass and the dot creation timing in the backward pass. The CPU 81 then inputs the colors selected by the user as the target of adjustment (step S120).

As clearly understood from the map of FIG. 19, the adjustment of the dot creation timing has not yet been finished with regard to the medium-sized dot and the small-sized dot. The CPU 81 accordingly returns to the processing of step S100, whether or not any target adjustment is selected at step S120. When any color is selected as the target of adjustment, the test patterns in the selected color are printed with the varying dot creation timings as shown in FIG. 18. The CPU 81 then inputs the selected dot creation timing. After completing the adjustment with regard to the large-sized dot, the adjustment of the dot creation timing is performed with regard to the medium-sized dot. This corresponds to the combinations No. 4 in the map of FIG. 19. The inter-dot comparison patterns (see FIG. 20) with regard to the medium-sized dot are printed for all the colors including black.

After completing the adjustment with regard to the medium-sized dot, the inter-dot comparison patterns (see FIG. 20) are printed with regard to the small-sized dot. This corresponds to the combinations No. 5 in the map of FIG.

19. When any color is specified as the target of adjustment of the dot creation timing, the CPU 81 returns to step S100 and performs the process of adjusting the dot creation timing. With no specification of the color as the target of adjustment, the CPU 81 determines that all the settings of the dot creation timing have been concluded (step S125 in the flowchart of FIG. 14), and outputs the resultant timing table with the settings of the adjustment to the printer PRT (step S130). This process outputs the set of parameters for specifying the driving waveform in each of the forward pass and the backward pass with regard to each color to the printer PRT. These parameters are stored in the PROM of the printer PRT and specify the dot creation timings in the subsequent printing operations.

Turning now to FIG. 21, which shows an example of the timing table. The settings actually include the dot creation timings in the forward pass and in the backward pass with regard to all the variable size dots in the respective colors. For convenience of illustration, the table of FIG. 21 shows the dot creation timings in the forward pass and the backward pass with regard to only the large-sized dot in the respective colors. The dot creation timings in the respective passes for the respective colors are specified relative to the dot creation timing in the forward pass for black (K). As described above, in the example of FIG. 15, the test pattern No. 4 corresponds to the optimum dot creation timing in the forward pass for black (K). The value '4' is accordingly stored in the timing table. The values to attain the optimum dot creation timings are also stored with regard to the respective colors and the respective passes.

As shown in the table of FIG. 21, some ink dots require advancement of the dot creation timing from the previous state, while other ink dots require delay of the dot creation timing from the previous state. In the test pattern of FIG. 15, the creating position of the dot specified as the target of adjustment relatively shifts from left to right in the order of 1 to 5. FIG. 22 shows variations in position of dot creation according to the moving direction of the carriage. In more detail, FIG. 22(*a*) shows the variation in the forward pass. The process of gradually shifting the position of dot creation rightward in the order of 1 to 5 corresponds to the process of gradually delaying the dot creation timing. FIG. 22(*b*) shows the variation in the backward pass. The process of gradually shifting the position of dot creation rightward in the order of 1 to 5 corresponds to the process of gradually advancing the dot creation timing. When the dot specified as the target of interest is created in the forward pass, the dot creation timing is gradually delayed. When the dot specified as the target of interest is created in the backward pass, on the contrary, the dot creation timing is gradually advanced.

The CPU 81 specifies the quantity of regulation from the previous dot creation timing based on the value in the timing table, and subsequently varies the dot creation timing according to the specified quantity of regulation to delay in the forward pass and to advance in the backward pass. The dot creation timing is varied by changing the values set to the periods of duration n0 and n6 in the driving waveform as discussed previously. When adjusting the dot creation timing with regard to the large-sized dot, it is required to change only the data n0. When adjusting the dot creation timing with regard to the medium-sized dot, it is required to change only the data n6. Further, when adjusting the dot creation timing with regard to the small-sized dot, it is required to change the data n0 while changing the data n6 to compensate for the change of the data n0. For example, when the data n0 is decreased by a predetermined amount, the data n6 is increased by the same amount. This enables only the output timing of the driving waveform W1 to be varied without varying the output timing of the driving waveform W2. At step S130 in the flowchart of FIG. 14, the latest settings of the parameters are output to the printer PRT.

The above example regards the adjustment under the conditions that black is specified as the reference color and the large-sized dot as the reference dot. The following describes the method of specifying the reference color and the reference dot. As mentioned above, the adjustment should be performed to advance the dot creation timing from the previous state in some dots and to delay the dot creation timing from the previous state in other dots. It is desirable to select the reference color and the reference dot to attain a smooth adjustment of the dot creation timing.

Figure 23:
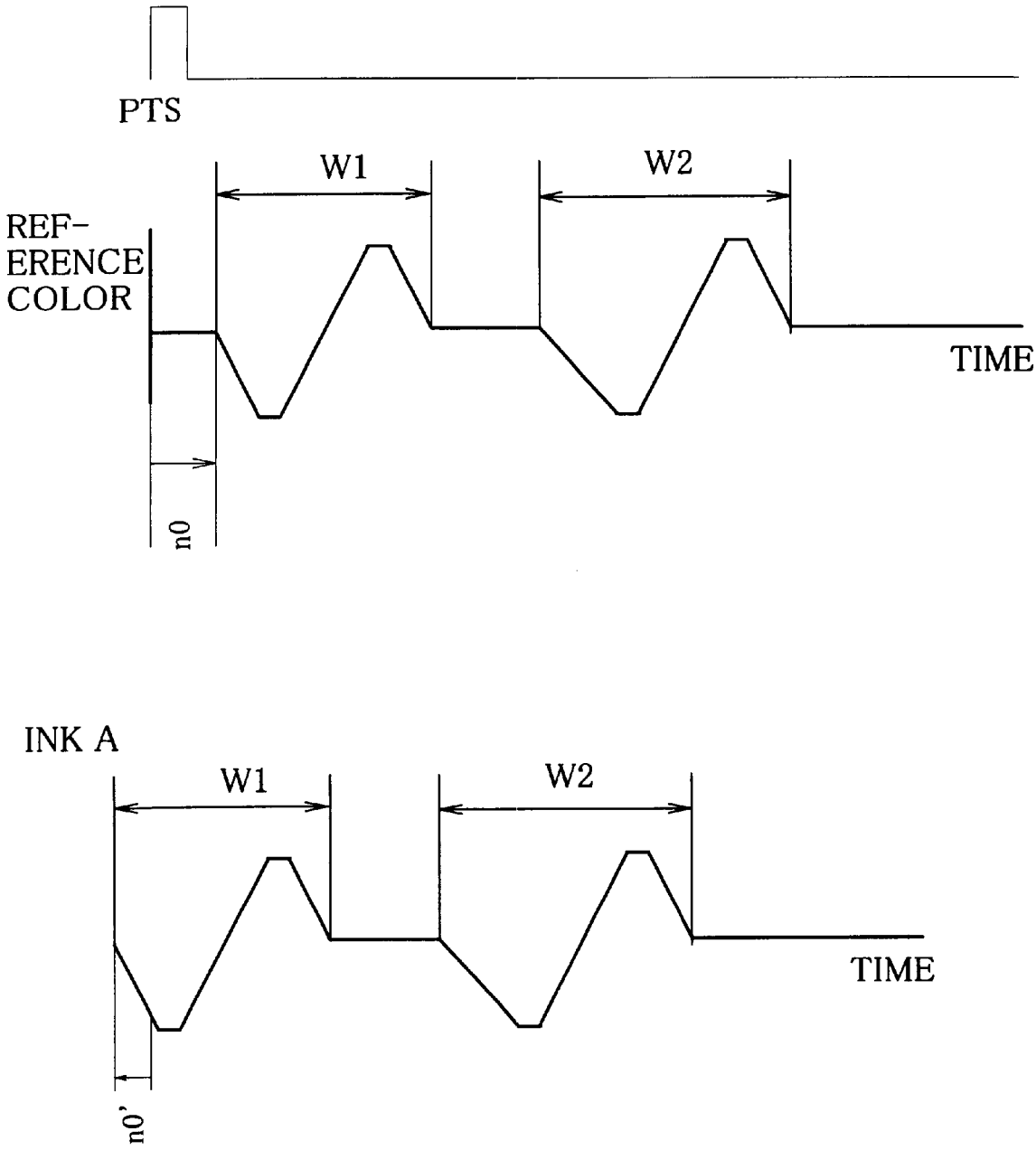
FIG. 23 shows a process of adjusting the dot creation timing when an ink having a relatively early output timing of the driving waveform is specified as the reference color.

FIG. 23 shows a process of adjusting the dot creation timing when an ink having a relatively early output timing of the driving waveform is specified as the reference color. As discussed previously with FIG. 16, the time interval between the output of the PTS signal and the output of the driving waveform W1 is defined as the period of duration n0. The upper portion of FIG. 23 shows the driving waveform of the reference color. Here a relatively small value is set to the period of duration n0. It is assumed the dot creation timing of a specific ink A should be earlier than the timing of the reference color. When the dot creation timing of the ink A should be advanced to an extent that exceeds the period of duration n0 until the output of the driving waveform W1 of the reference color, the driving waveform W1 of the ink A is output prior to the PTS signal.

The lower portion of FIG. 23 shows the driving waveform of the ink A after the adjustment. In this case, the period of duration n0 takes a negative value. The PTS signal synchronizes the output of print data with regard to each pixel, which represents the dot on-off state in the pixel, to the print head. Outputting the driving waveform W1 prior to the PTS signal causes the print head to be driven with no supply of the print data and accordingly does not ensure adequate printing. When there is any specific ink having the dot creation timing earlier than the output of the PTS signal, additional processing is required to delay the dot creation timings of all the colors including the reference color, to make the dot creation timing of the specific ink later than the output of the PTS signal. This makes the adjustment of the dot creation timing undesirably complicated. It is accordingly preferable to select, as the reference color, the ink having a sufficient time interval between the output of the PTS signal and the output of the driving waveform.

Figure 24:
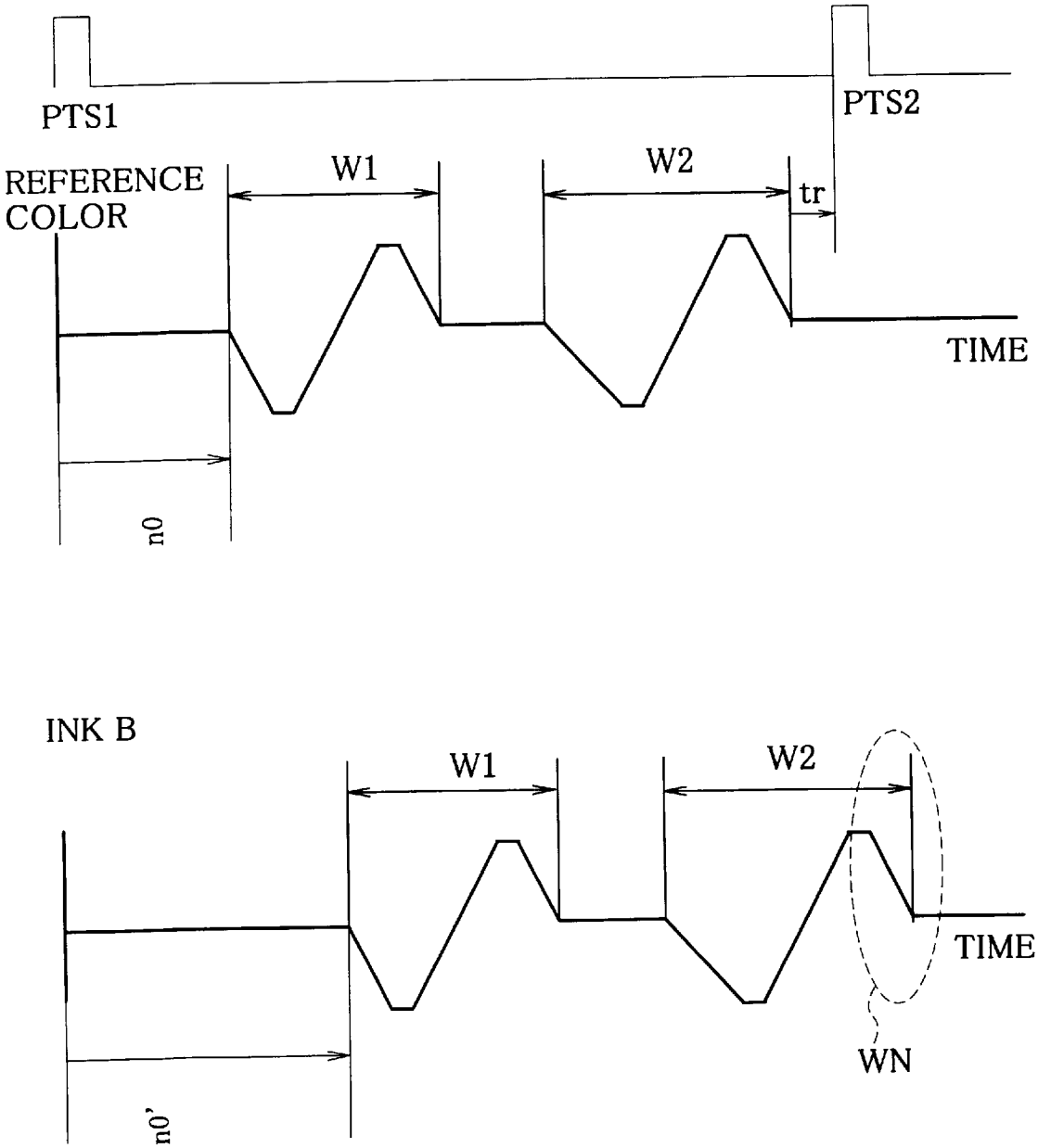
FIG. 24 shows a process of adjusting the dot creation timing when an ink having a relatively late output timing of the driving waveform is specified as the reference color.

The ink having an excessively late dot creation timing is also inadequate for the reference color. FIG. 24 shows a process of adjusting the dot creation timing when an ink having a relatively late output timing of the driving waveform is specified as the reference color. The upper portion of FIG. 24 shows the driving waveform of the reference color. Here a relatively large value is set to the period of duration n0. It is assumed the dot creation timing of a specific ink B should be later than the timing of the reference color. When the dot creation timing of the ink B should be delayed to an extent that exceeds a time period tr between the end of the output of the driving waveform W2 of the reference color and the start of the output of a next pulse PTS2 of the PTS signal, the rear end of the driving waveform W2 of the ink B occurs after the pulse PTS2.

Outputting the pulse PTS2 during the output of the driving waveform W2 interferes with the adequate printing. When there is any specific ink having the rear end of the driving waveform later than the next pulse PTS2 of the PTS signal, additional processing is required to entirely advance the dot creation timings of all the colors including the reference color, to make the output of the driving waveform complete prior to the next pulse PTS2 of the PTS signal. This makes the adjustment of the dot creation timing undesirably complicated. It is accordingly preferable to select, as the reference color, the ink having a sufficient time interval between the rear end of the driving waveform and the next pulse PTS2 of the PTS signal.

The technique of this example selects the reference color by taking into account both the factors discussed above with FIGS. 23 and 24. Namely, the ink having a substantially intermediate dot creation timing among the dot creation timings of the respective colors is selected as the reference color. Such selection enables the adjustment of the dot creation timing to be practically completed in the time interval of the output of the PTS signal.

Similarly, the reference dot is to be selected to attain smooth adjustment of the dot creation timing for all the variable dots. The printer PRT creates the small-sized dot with the driving waveform W1, the medium-sized dot with the driving waveform W2, and the large-sized dot with both the driving waveforms W1 and W2. As discussed previously with FIG. 12, the driving waveform W1 causes an ink droplet corresponding to the small-sized dot to be ejected at a lower flight velocity. The driving waveform W2 causes an ink droplet corresponding to the medium-sized dot to be ejected at a higher flight velocity.

Here it is assumed the medium-sized dot having the high flight velocity is used as the reference dot for the adjustment of the dot creation timing. When there is a relatively short time interval between the output of the PTS signal and the output of the driving waveform W2, a similar state to that discussed previously with FIG. 23 may arise. Namely, there is a possibility the driving waveform W1 is to be output prior to the PTS signal in the process of adjusting the dot creation timing of the small-sized dot.

Then it is assumed the small-sized dot having the low flight velocity is used as the reference dot for the adjustment of the dot creation timing. When there is a relatively long time interval between the output of the PTS signal and the output of the driving waveform W1, a similar state to that discussed previously with FIG. 24 may arise. Namely, there is a possibility that the rear end of the driving waveform W2 may be located after the next pulse of the PTS signal in the process of adjusting the dot creation timing of the medium-sized dot. The driving waveforms W1 and W2 are output successively. When there is a requirement to advance the dot creation timing of the medium-sized dot, the rear end of the driving waveform W1 may overlap the front end of the driving waveform W2.

Based on these factors, it is preferable to select the dot having the intermediate flight velocity as the reference dot. In this example, the large-sized dot created with both the driving waveforms W1 and W2 is desirably used as the reference dot. Another point of selection for the reference dot is that the positional misalignment of the dot has significant effects on the picture quality. From this point of view, the large-sized dot is preferably selected as the reference dot in this example.

In the structure of this example, since there is no significant difference in ink ejection speed among the respective color inks, the reference color is selected based on the dot creation timing. When there is a significant difference in ink ejection speed among the respective inks, however, the reference color may be selected by taking into account the flight velocities of the respective inks as in the case of the selection of the reference dot. In this case, the ink having the intermediate flight velocity may be selected as the reference color. Another preferable application selects the reference color according to the above procedure every time the adjustment of the dot creation timing is performed.

The printing system discussed above adjusts the dot creation timing with regard to each ink and each of the variable dots. This arrangement effectively reduces the positional misalignment of dot creation during bidirectional recording and thereby improves the picture quality of the resulting printed image. While the background printing system enables the adjustment of the dot creation timing only for one color and one type of dot, the printing system according to the present inventions enables the adjustment of the dot creation timing for all the different inks and all the different types of dots. This point is of great significance. This arrangement enables the adjustment of the dot creation timing to be performed especially for the dot having the significant effects on the picture quality in the case of bidirectional recording and thereby remarkably enhances the picture quality of the resulting printed image.

Another characteristic of the printing system according to the present invention is a light burden in the process of adjusting the dot creation timing. Adjustment of the dot creation timing with regard to all the combinations of multiple colors and variable dots is extremely burdensome. In practice, a sufficient adjustment is virtually impossible. The technique of the present invention, on the other hand, checks the inter-dot comparison pattern, selects the dots of interest as the target of adjustment, and actually performs the adjustment. This arrangement effectively alleviates the load in the process of adjusting the dot creation timing. This method also ensures the sufficient adjustment for the dot having the positional misalignment that actually affects the picture quality.

Further, the procedure of the present invention uses the test pattern in which the dots created in the forward pass and the dots created in the backward pass are arranged checkerwise (see FIG. 15). The test pattern used for the adjustment of the dot creation timing is not restricted to this arrangement, but may have a variety of modified arrangements.

Figure 25:
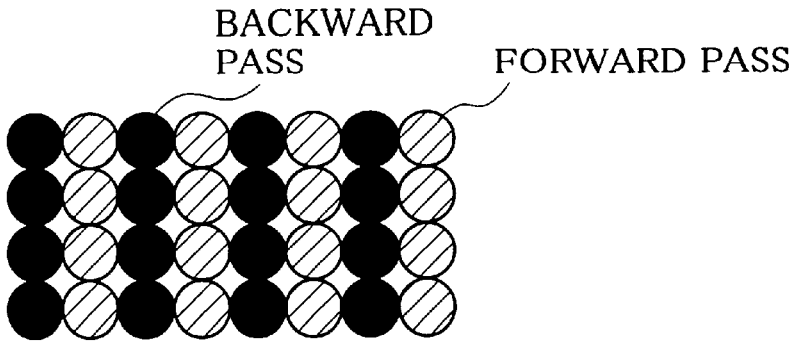
FIG. 25 shows another test pattern.
Figure 26:
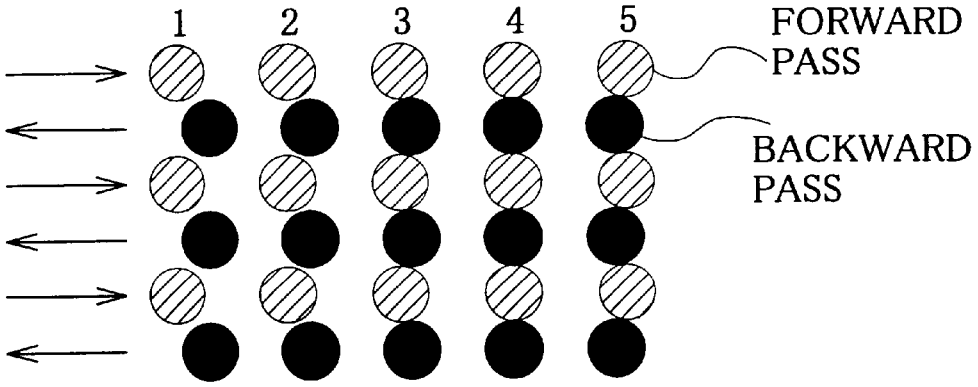
FIG. 26 shows still another test pattern.

FIG. 25 shows another test pattern as a first modified example. This test pattern modifies the arrangement of dots shown in FIG. 15 and includes the dots created in the forward pass and the dots created in the backward pass to be respectively aligned in the main scanning direction. FIG. 26 shows still another test pattern as a second modified example. This test pattern includes ruled lines drawn in the sub-scanning direction with the dots created in the forward pass and the dots created in the backward pass. In the example of FIG. 26, the dot creation timing in the backward pass is varied in five different stages. The state of No. 4 in the test pattern corresponds to the optimum dot creation timing. A variety of other patterns may be applied for the test pattern as long as they enable the deviation of the dot creation timing to be clearly detected.

Figure 27:
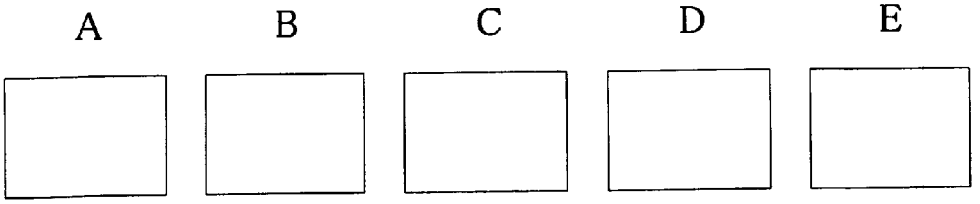
FIG. 27 shows printed results for selecting the test pattern.

One preferable application prints a variety of test patterns and enables the user to select a desired test pattern that facilitates recognition of the positional misalignment of dots. FIG. 27 shows the printed results for selecting the test pattern. Predetermined test patterns A through E are printed prior to the adjustment of the dot creation timing, and the user selects a desired pattern used for the adjustment. The recognizability of the positional misalignment of dots in each test pattern may depend upon the reference color and the size of the reference dot. The application of allowing selection of the desired pattern ensures the adequate adjustment.

In the example discussed above, the small-sized dot and the medium-sized dot have different flight velocities of ink. The technique of the present invention may be applicable with appropriate modification according to the flight velocities of the respective dots and the output states of the driving waveforms in the forward pass and in the backward pass.

Figure 28:
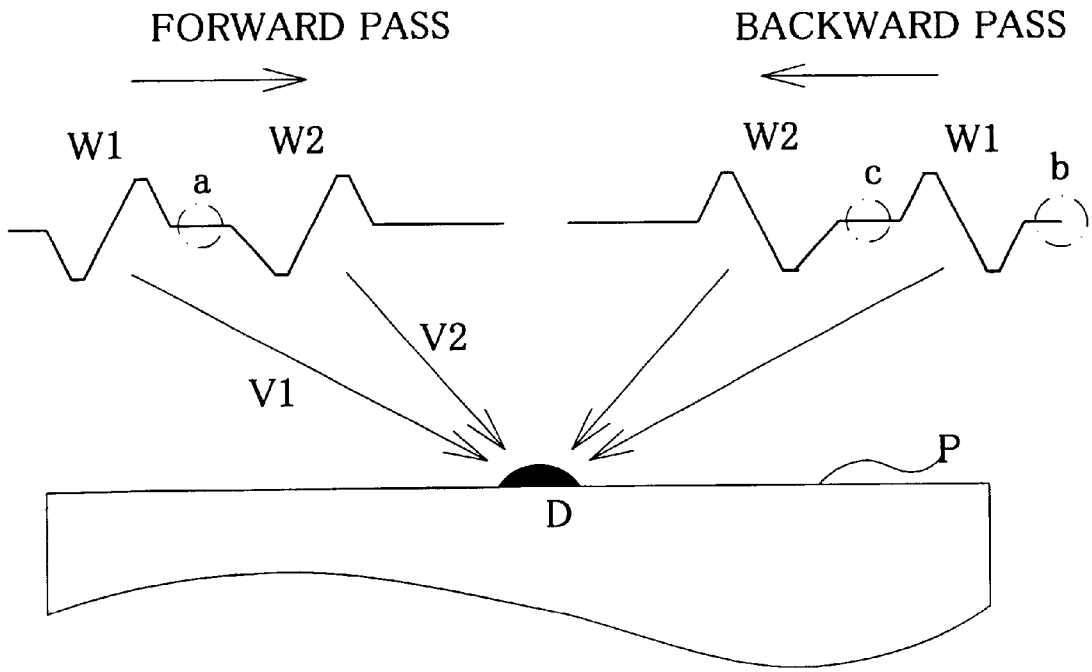
FIG. 28 shows a process of adjusting the dot creation timing when the small-sized dot and the medium-sized dot have different flight velocities.

In more detail, FIG. 28 shows a process of adjusting the dot creation timing when the small-sized dot and the medium-sized dot have different flight velocities. This corresponds to the state discussed above. The driving waveform W1 causes ink to be ejected at a low flight velocity V1 and create the small-sized dot. The driving waveform W2 causes ink to be ejected at a high flight velocity V2 and create the medium-sized dot. Although the technique of the present invention omits the adjustment of the dot creation timings between the different-sized dots, regulating a time interval 'a' between the two driving waveforms W1 and W2 enables the small-sized dot and the medium-sized dot to be formed at an identical position D on the printing paper P.

In the backward pass, the moving direction of the carriage is inverted. The driving waveforms W1 and W2 are output in the state shown in FIG. 28. Regulating a time interval 'b' until the output of the driving waveform W1 in the backward pass enables the hitting position of the small-sized dot to be adjusted. Regulating a time interval 'c' between the two driving waveforms W1 and W2 enables the hitting position of the medium-sized dot to be adjusted. In the case where the different driving waveforms cause different flight velocities of ink, using the identical waveforms in both the forward pass and the backward pass enables the position of dot creation in the backward pass to be coincident with the position of dot creation in the forward pass.

The above example regards the case of bidirectional recording. When the variable dots of different ink quantities have different ink ejection speeds as shown in FIG. 28, the creating position of each dot is adjustable by varying the time interval 'a'. The technique is thus applicable to reduce the positional misalignment of each of the variable dots having different ink quantities and improve the picture quality of the resulting printed image not only in the printing system that performs bidirectional recording, but in the printing system that performs unidirectional recording. The method of adjusting the dot creation timing in the course of unidirectional recording is similar to that in the course of bidirectional recording and is thus not specifically described here.

Figure 29:
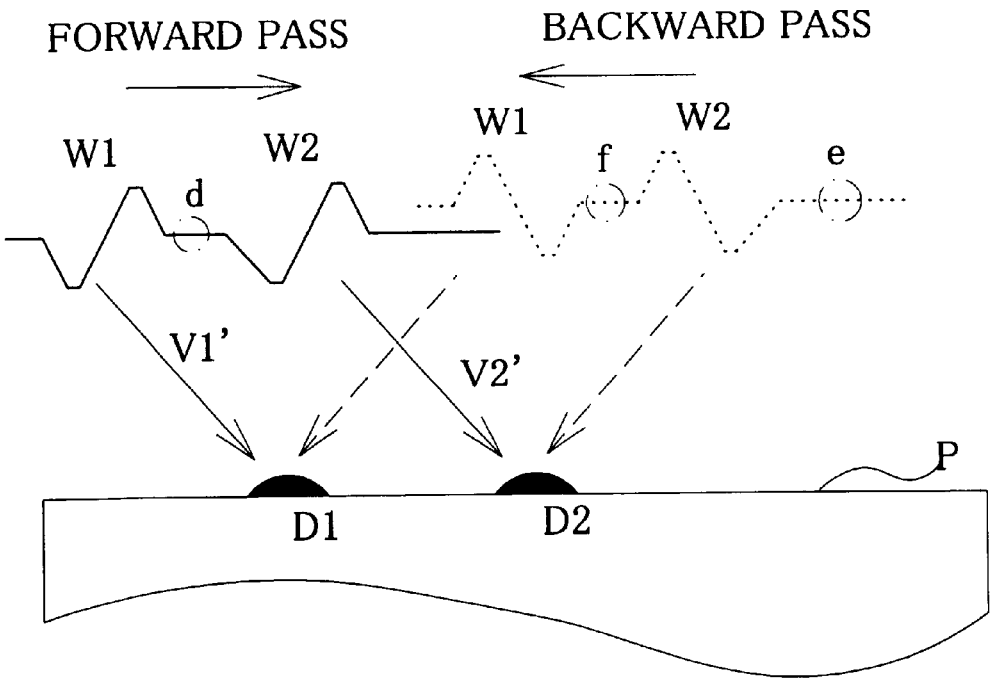
FIG. 29 shows a process of adjusting the dot creation timing when the small-sized dot and the medium-sized dot have an identical flight velocity.

FIG. 29 shows a process of adjusting the dot creation timing when the small-sized dot and the medium-sized dot have an identical flight velocity. Namely, a flight velocity V1' in response to the driving waveform W1 is substantially identical with a flight velocity V2' in response to the driving waveform W2. In the forward pass, the small-sized dot is formed at a position D1 on the printing paper P, whereas the medium-sized dot is formed at another position D2. In this case, regulating a time interval 'd' between the two driving waveforms W1 and W2 causes the small-sized dot and the medium-sized dot to be formed in an identical pixel, although it is impossible to make the positions of dot creation completely identical with each other.

In the backward pass, the moving direction of the carriage is inverted. When the small-sized dot and the medium-sized dot have an identical flight velocity, it is desirable to invert the output order of the driving waveforms in the backward pass. As shown in FIG. 29, the desirable procedure outputs the driving waveforms W1 and W2 in this sequence in the forward pass, while outputting the driving waveforms W2 and W1 in this sequence in the backward pass. In this case, regulating a time interval 'e' until the output of the driving waveform W2 in the backward pass enables the hitting position of the medium-sized dot to be coincident with the position D2. Regulating a time interval 'f' between the two driving waveforms W1 and W1 in the backward pass enables the hitting position of the small-sized dot to be coincident with the position D1.

When the different driving waveforms cause an identical flight velocity, the arrangement of inverting the output order of the driving waveforms in the backward pass enables the creating position of each dot in the backward pass to be coincident with that in the forward pass. The technique of the present invention is not restricted to the applications discussed above, but may be applicable with adequate modification according to the flight velocities of the respective dots and the output states of the driving waveforms in the forward pass and in the backward pass.

Figure 30:
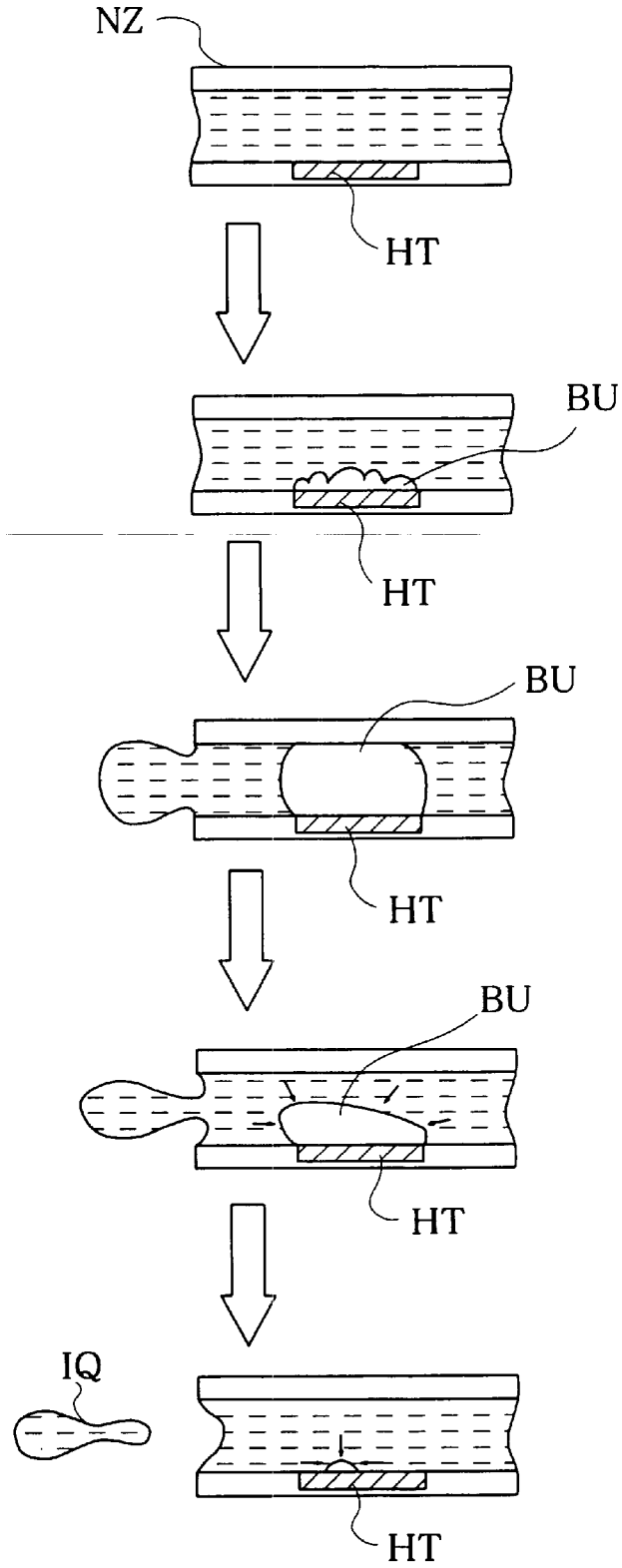
FIG. 30 shows the principle of ejecting ink by power supply to heaters.

Turning now to another example of the present invention in which the printer PRT has a different print head from that of the first example. While the print head of the first example utilizes the piezoelectric elements for ink ejection, the print head in this example ejects ink by power supply to heaters. In more detail, FIG. 30 shows the principle of ejecting ink by power supply to the heaters. A heater HT is disposed in the ink conduit of each nozzle Nz, power is supplied to the heater HT causes air bubbles BU in the ink, and an ink droplet IQ is ejected by the pressure of the air bubbles BU. In one practical application, two heaters are installed in each nozzle. Two variable size dots, that is, the large-sized dot and the small-sized dot, are created by changing the state of power supply to the respective heaters. The small-sized dot is created when the power is supplied to only one of the two heaters, and the large-sized dot is created when the power is supplied to both the heaters.

Figure 31:
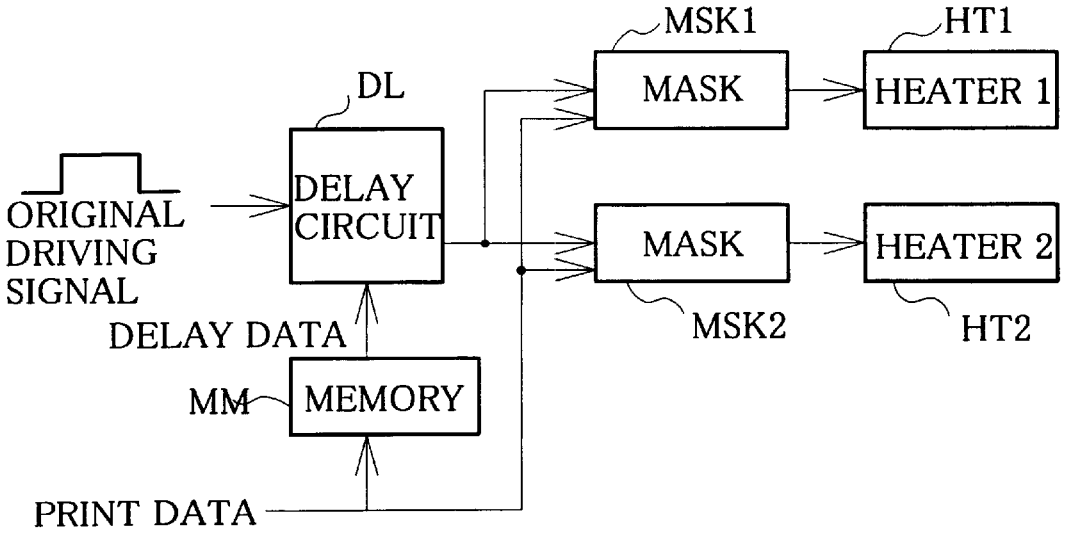
FIG. 31 shows another structure of the driving signal generator.

Because of the difference in mechanism of the print head, the driving signal generator 55 in the printer PRT has a different configuration from that of the first example. In more detail, FIG. 31 shows the structure of the driving signal generator in the second example. An original driving signal is output from a transmitter to heaters HT1 and HT2 provided in each nozzle via a delay circuit DL at a specific timing corresponding to each pixel. Mask circuits MSK1 and MSK2 are disposed respectively before the heaters HT1 and HT2 to mask the driving waveforms according to the print data. When the print data represents creation of no dot, both the mask circuits MSK1 and MSK2 mask the driving waveforms to cut the power supply to both the heaters HT1 and HT2. When the print data represents creation of the small-sized dot, only the mask circuit MSK2 masks the driving waveform to allow the power supply only to the heater HT1. When the print data represents creation of the large-sized dot, neither of the mask circuits masks the driving waveforms to allow the power supply to both the heaters HT1 and HT2.

The delay circuit DL functions to adjust the output timings of the original driving signal to the heaters HT1 and HT2. The adjustment of the output timings follows delay data stored in a memory MM. The memory MM stores the delay data with regard to the small-sized dot and the large-sized dot in both the forward pass and the backward pass. The delay data according to the print data and the pass of the main scan are read from the memory MM to allow the power supply to the heaters HT1 and HT2 at appropriate timings and create the respective dots.

Figure 32:
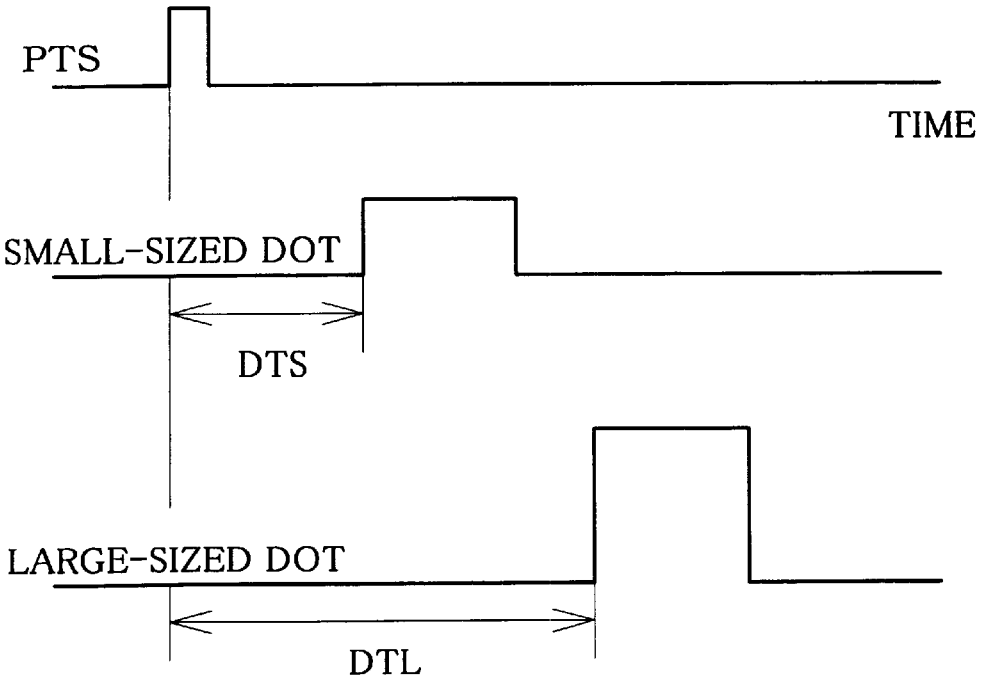
FIG. 32 shows another process of adjusting the dot creation timing.

FIG. 32 shows a process of adjusting the dot creation timing in the second example. The original driving signal is output synchronously with the PTS signal corresponding to each pixel. With regard to the small-sized dot, a driving signal is output with a delay time DTS after the output of the PTS signal. With regard to the large-sized dot, a driving signal is output with a delay time DTL after the output of the PTS signal. The memory MM stores a value corresponding to the delay time DTS as the delay data on the small-sized dot and a value corresponding to the delay time DTL as the delay data on the large-sized dot. The creation timing of each of the variable dots is individually adjusted by individually regulating the delay time of the dot.

A series of processing similar to that of the first example is applied for the adjustment of the dot creation timing. The procedure prints the test pattern shown in FIG. 15, causes the user to select the optimum timing, and actually performs the adjustment of the dot creation timing. The procedure of the first example adjusts the dot creation timing by changing the periods of duration among the various parameters for specifying the driving waveform. Further, the procedure of the second example, on the other hand, adjusts the dot creation timing by changing the delay data. To allow the adjustment of the dot creation timing in a variety of combinations, one preferable application of the second example prints an inter-dot comparison pattern, selects the dots of interest as the target of adjustment, and actually performs the adjustment of the dot creation timing.

The printing system of the second example discussed above adequately adjusts the dot creation timing when outputting individual driving waveforms corresponding to the variable dots. Like the first example, the arrangement of the second example effectively reduces the positional misalignment of dots in the course of bidirectional recording and thus remarkably improves the picture quality of the resulting printed image.

In addition, the second example corresponds to the case of bidirectional recording. In the print head of the second example, the creating position of each of the variable dots having different ink quantities is adjustable by changing the time interval between the output of the PTS signal and the output of the driving waveform. The technique is thus applicable to reduce the positional misalignment of each of the variable dots having different ink quantities and to improve the picture quality of the resulting printed image not only in the printing system that performs bidirectional recording, but in the printing system that performs unidirectional recording. The method of adjusting the dot creation timing in the course of unidirectional recording is similar to that in the course of bidirectional recording and is thus not specifically described here.

Further, the first example uses the print head that utilizes the piezoelectric elements for ink ejection, and the second example uses the print head that ejects ink by supplying power to the heaters. However, the procedures of the respective examples are not restricted to the print heads of such structures. The technique of the first example is applicable to any printing system in which driving waveforms corresponding to a plurality of variable dots are successively output to each pixel. For example, the print head that ejects ink by supplying power to the heaters may be driven with such driving waveforms. The technique of the second example is also applicable to any printing system in which only the driving waveform corresponding to each of the variable dots is output. For example, the technique may be applicable to the printing system that outputs different driving waveforms corresponding to the variable dots to the print head that ejects ink by utilizing the piezoelectric elements. These techniques of the examples may also be applicable to the printing systems having other structures.

The technique of the above example prints the test pattern by varying the dot creation timing in five different stages and enables the user to select the optimum timing. This method of adjusting the dot creation timing is only an example. Another application repeats the process of inputting the dot creation timing and printing the test pattern at the input dot creation timing, so as to eventually attain the optimum dot creation timing. The functions of the computer 90, the printer driver 96, and the input unit 92 may be incorporated in the printer PRT, so that the printer PRT can independently adjust the dot creation timing.

This invention may be conveniently implemented using a conventional general purpose digital computer or microprocessor programmed according to the teachings of the present specification, as will be apparent to those skilled in the computer art. Appropriate software coding can readily be prepared by skilled programmers based on the teachings of the present disclosure, as will be apparent to those skilled in the software art. The invention may also be implemented by the preparation of application specific integrated circuits or by interconnecting an appropriate network of conventional component circuits, as will be readily apparent to those skilled in the art.

The present invention includes a computer program product which is a storage medium including instructions which can be used to program a computer to perform a process of the invention. The storage medium can include, but is not limited to, an type of disk including floppy disks, optical disks, CD-ROMs, and magneto-optical disks, ROMs, RAMs, EPROMs, EEPROMs, magnetic or optical cards, or any type of pure software inventions (e.g., word processing, accounting, Internet related, etc.) media suitable for storing electronic instructions.

The above examples are to be considered in all aspects as illustrative and not restrictive. There may be many modifications, changes, and alterations without departing from the scope or spirit of the main characteristics of the present invention. For example, the series of the processing attained by software may be actualized by the hardware or vice versa.

What is claimed is:

1. A printing system that creates dots on a printing medium in the course of a main scan and thereby prints an image, said printing system comprising:

a print head configured to create n variable dots (where n is an integer of not less than 2), which at least partly include dots of an identical ink but different ink quantities, in response to driving signals so as to print an image on a printing medium;

a memory configured to store output timings of n driving signals corresponding to the n variable dots to adjust positional misalignments of the n variable dots;

a driving signal output unit configured to output at least part of the n driving signals to said print head in the course of the main scan, according to dots to be created in respective pixels;

a timing adjustment unit configured to individually adjust the output timings stored in said memory with regard to each identical ink and each of the different ink quantities of the n variable dots; and a test pattern printing unit configured to print a predetermined test pattern, which is set to enable detection of the relative positional misalignment of dots created under different printing conditions, with regard to each of the n variable dots, wherein the printing conditions include printing the same color with different densities.

2. A printing system in accordance with claim 1, wherein said memory stores the output timings of the n driving signals with regard to a forward pass of the main scan separately from those with regard to a backward pass of the main scan, wherein said driving signal output unit outputs at least part of the n driving signals to said print head in each of the forward pass and the backward pass of the main scan, and wherein said timing adjustment unit individually adjusts the output timings stored in said memory with regard to each of the n variable dots so as to allow a relative change of an output timing in the backward pass to an output timing in the forward pass.

3. A printing system in accordance with claim 1, further comprising:

a reference signal output unit configured to output a reference signal, which is related to an output of the driving signal, at a fixed period corresponding to each pixel based on a rate of the main scan, wherein said print head drives specific elements that correspond to the n variable dots to create the n variable dots, and wherein said memory stores a delay time from the reference signal as each of the output timings.

4. A printing system in accordance with claim 1, wherein said driving signal output unit comprises:

an original driving signal output unit configured to successively output a plurality of original driving signals to each pixel; and a selection unit configured to select at least part of the original driving signals so as to generate the n driving signals corresponding to the n variable dots, wherein said memory stores an interval of each original driving signal as each of the output timings.

5. A printing system in accordance with claim 1, wherein said timing adjustment unit adjusts the output timing based on a relation to a printed result of the predetermined test pattern.

6. A printing system in accordance with claim 5, further comprising:

an inter-dot comparison pattern printing unit configured to print predetermined patterns, in each of which dots created under different printing conditions are mixed, with regard to at least two variable dots of interest creatable by said print head, in a specific arrangement that enables mutual comparison; and a selecting instruction input unit configured to input a selecting instruction to select a specific dot among the at least two variable dots of interest, which are subjected to printing by said inter-dot comparison pattern printing unit, wherein said test pattern printing unit prints the predetermined test pattern with regard to the selected specific dot.

7. A printing system in accordance with claim 1, wherein said timing adjustment unit adjusts an output timing of another driving signal corresponding to another dot, relative to an output timing of one driving signal corresponding to one reference dot selected among the n variable dots.

8. A printing system in accordance with claim 7, wherein the reference dot has a substantially intermediate ink ejection speed among the n variable dots.

9. A printing system in accordance with claim 7, wherein the reference dot has a substantially intermediate output timing of the corresponding reference signal among the n variable dots.

10. A printing system that creates dots on a printing medium in the course of a main scan and thereby prints an image, said printing system comprising:

printing means for creating n variable dots (where n is an integer of not less than 2), which at least partly include dots of an identical ink but different ink quantities, in response to driving signals so as to print an image on a printing medium;

memory means for storing output timings of n driving signals corresponding to the n variable dots to adjust positional misalignments of the n variable dots;

driving signal means for outputting at least part of the n driving signals to said printing means in the course of the main scan, according to dots to be created in respective pixels;

adjustment means for individually adjusting the output timings stored in said memory means with regard to each identical ink and each of the different ink quantities of the n variable dots; and test pattern printing means for printing a predetermined test pattern, which is set to enable detection of the relative positional misalignment of dots created under different printing conditions, with regard to each of the n variable dots, wherein the printing conditions include printing the same color with different densities.

11. A printing system in accordance with claim 10, wherein said memory means stores the output timings of the n driving signals with regard to a forward pass of the main scan separately from those with regard to a backward pass of the main scan, wherein said driving signal means outputs at least part of the n driving signals to said printing means in each of the forward pass and the backward pass of the main scan, and wherein said adjustment means individually adjusts the output timings stored in said memory means with regard to each of the n variable dots so as to allow a relative change of an output timing in the backward pass to an output timing in the forward pass.

12. A printing system in accordance with claim 10, further comprising:

reference signal means for outputting a reference signal, which is related to an output of the driving signal means, at a fixed period corresponding to each pixel based on a rate of the main scan, wherein said printing means drives specific elements that correspond to the n variable dots to create the n variable dots, and wherein said memory means stores a delay time from the reference signal as each of the output timings.

13. A printing system in accordance with claim 10, wherein said driving means comprises:

original driving signal means for successively outputting a plurality of original driving signals to each pixel; and selection means for selecting at least part of the original driving signals so as to generate the n driving signals corresponding to the n variable dots, wherein said memory means stores an interval of each original driving signal as each of the output timings.

14. A printing system in accordance with claim 10, wherein said timing adjustment means adjusts the output timing based on a relation to a printed result of the predetermined test pattern.

15. A printing system in accordance with claim 14, further comprising:

inter-dot comparison pattern printing means for printing predetermined patterns, in each of which dots created under different printing conditions are mixed, with regard to at least two variable dots of interest creatable by said printing means, in a specific arrangement that enables mutual comparison; and selecting instruction input means for inputting a selecting instruction to select a specific dot among the at least two variable dots of interest, which are subjected to printing by said inter-dot comparison pattern printing means, wherein said test pattern printing means prints the predetermined test pattern with regard to the selected specific dot.

16. A printing system in accordance with claim 10, wherein said timing adjustment means adjusts an output timing of another driving signal corresponding to another dot, relative to an output timing of one driving signal corresponding to one reference dot selected among the n variable dots.

17. A printing system in accordance with claim 16, wherein the reference dot has a substantially intermediate ink ejection speed among the n variable dots.

18. A printing system in accordance with claim 16, wherein the reference dot has a substantially intermediate output timing of the corresponding reference signal among the n variable dots.

19. A method of printing that creates dots on a printing medium in the course of a main scan and thereby prints an image including a print head configured to create n variable dots (where n is an integer of not less than 2), which at least partly include dots of an identical ink but different ink quantities, in response to driving signals so as to print the image on the printing medium, said method comprising the steps of:

storing output timings of n driving signals corresponding to the n variable dots to adjust positional misalignments of the n variable dots;

outputting at least part of the n driving signals to said print head in the course of the main scan, according to dots to be created in respective pixels;

individually adjusting the output timings stored in the storing step with regard to each identical ink and each of the different ink quantities of the n variable dots; and printing a predetermined test pattern, which is set to enable detection of the relative positional misalignment of dots created under different printing conditions, with regard to each of the n variable dots, wherein the printing conditions include printing the same color with different densities.

20. A printing method in accordance with claim 19, wherein said storing step stores the output timings of the n driving signals with regard to a forward pass of the main scan separately from those with regard to a backward pass of the main scan, wherein said step of outputting the n driving signals outputs at least part of the n driving signals to said print head in each of the forward pass and the backward pass of the main scan, and wherein said adjusting step individually adjusts the output timings stored in said storing step with regard to each of the n variable dots so as to allow a relative change of an output timing in the backward pass to an output timing in the forward pass.

21. A printing method in accordance with claim 19, further comprising:

outputting a reference signal, which is related to an output by the step of outputting the n driving signals, at a fixed period corresponding to each pixel based on a rate of the main scan, wherein said print head drives specific elements that correspond to the n variable dots to create the n variable dots, and wherein said storing step stores a delay time from the reference signal as each of the output timings.

22. A printing method in accordance with claim 19, wherein said step of outputting the n driving signals comprises:

successively outputting a plurality of original driving signals to each pixel; and selecting at least part of the original driving signals so as to generate the n driving signals corresponding to the n variable dots, wherein said storing step stores an interval of each original driving signal as each of the output timings.

23. A printing method in accordance with claim 19, wherein said adjusting step adjusts the output timing based on a relation to a printed result of the predetermined test pattern.

24. A printing method in accordance with claim 19, further comprising:

printing predetermined patterns, in each of which dots created under different printing conditions are mixed, with regard to at least two variable dots of interest creatable by said print head, in a specific arrangement that enables mutual comparison; and inputting a selecting instruction to select a specific dot among the at least two variable dots of interest, which are subjected to printing by the step of printing predetermined test patterns, wherein said step of printing the predetermined test pattern prints the predetermined test pattern with regard to the selected specific dot.

25. A printing method in accordance with claim 19, wherein the adjusting step adjusts an output timing of another driving signal corresponding to another dot, relative to an output timing of one driving signal corresponding to one reference dot selected among the n variable dots.

26. A printing method in accordance with claim 25, wherein the reference dot has a substantially intermediate ink ejection speed among the n variable dots.

27. A printing method in accordance with claim 25, wherein the reference dot has a substantially intermediate output timing of the corresponding reference signal among the n variable dots.

28. A printing method in accordance with claim 19, further comprising:

(a) printing the predetermined test pattern;

(b) imputting a present output timing of a selected driving signal, which is specified, based on a relation to the printed test pattern; and (c) changing an existing value of the output timing to the preset output timing.

29. A printing method in accordance with claim 28, further comprising, prior to the step (a):

(a1) printing predetermined patterns, in each of which dots created under different printing conditions are mixed, with regard to at least two variable dots of interest creatable by said print head, in a specific arrangement that enables mutual comparison; and (a2) inputting a selecting instruction to select a specific dot among the at least two variable dots of interest, which are subjected to the printing in said step (a1), wherein said step (a) prints the predetermined test pattern with regard to the specific dot selected in said step (a2).

30. A printing method in accordance with claim 28, wherein said print head is configured to create dots with multiple color inks, and wherein said method further comprises:

performing said steps (a) through (c) with regard to dots created under different printing conditions with one identical ink selected among the multiple color inks; and performing said steps (a) through (c) with regard to dots created with different inks selected among the multiple color inks.

31. A computer program product for driving a printing system that creates dots on a printing medium in the course of a main scan and thereby prints an image including a print head configured to create n variable dots (where n is an integer of not less than 2), which at least partly include dots of an identical ink but different ink quantities, in response to driving signals so as to print the image on the printing medium, said computer program product comprising:

a first computer code configured to store output timings of n driving signals corresponding to the n variable dots to adjust positional misalignments of the n variable dots;

a second computer code configured to output at least part of the n driving signals to said print head in the course of the main scan, according to dots to be created in respective pixels;

a third computer code configured to individually adjust the output timings stored by the first computer code with regard to each identical ink and each of the different ink quantities of the n variable dots; and a fourth computer code configured print a predetermined test pattern, which is set to enable detection of the relative positional misalignment of dots created under different printing conditions, with regard to each of the n variable dots, wherein the printing conditions include printing the same color with different densities.

32. A computer program product in accordance with claim 31, wherein the first computer code stores the output timings of the n driving signals with regard to a forward pass of the main scan separately from those with regard to a backward pass of the main scan, wherein said second computer code outputs at least part of the n driving signals to said print head in each of the forward pass and the backward pass of the main scan, and wherein said third computer code individually adjusts the output timings stored by said first computer code with regard to each of the n variable dots so as to allow a relative change of an output timing in the backward pass to an output timing in the forward pass.

33. A computer program product in accordance with claim 31, further comprising:

a fourth computer code configured to output a reference signal, which is related to an output by the second computer code, at a fixed period corresponding to each pixel based on a rate of the main scan, wherein said print head drives specific elements that correspond to the n variable dots to create the n variable dots, and wherein said first computer code stores a delay time from the reference signal as each of the output timings.

34. A computer program product in accordance with claim 31, wherein the second computer code comprises:

a fourth computer code configured to successively output a plurality of original driving signals to each pixel; and a fifth computer code configured to select at least part of the original driving signals so as to generate the n driving signals corresponding to the n variable dots, wherein said first computer code stores an interval of each original driving signal as each of the output timings.

35. A computer program product in accordance with claim 31, wherein said third computer code adjusts the output timing based on a relation to a printed result of the predetermined test pattern.

36. A computer program product in accordance with claim 35, further comprising:

a fifth computer code configured to print predetermined patterns, in each of which dots created under different printing conditions are mixed, with regard to at least two variable dots of interest creatable by said print head, in a specific arrangement that enables mutual comparison; and a sixth computer code configured to input a selecting instruction to select a specific dot among the at least two variable dots of interest, which are subjected to printing by the fifth computer code, wherein said fourth computer code prints the predetermined test pattern with regard to the selected specific dot.

37. A computer program product in accordance with claim 31, wherein the third computer code adjusts an output timing of another driving signal corresponding to another dot, relative to an output timing of one driving signal corresponding to one reference dot selected among the n variable dots.

38. A computer program product in accordance with claim 37, wherein the reference dot has a substantially intermediate ink ejection speed among the n variable dots.

39. A computer program product in accordance with claim 37, wherein the reference dot has a substantially intermediate output timing of the corresponding reference signal among the n variable dots.

* * * * *